US009920899B2

(12) United States Patent
Rector et al.

(10) Patent No.: US 9,920,899 B2
(45) Date of Patent: Mar. 20, 2018

(54) LUMINAIRE

(71) Applicant: Hubbell Incorporated, Shelton, CT (US)

(72) Inventors: David Rector, Mauldin, SC (US); Raymond Brown, Greer, SC (US); Jeffrey Spitzer, Taylors, SC (US); Kenneth Macintosh, Ivyland, PA (US); Seng Vang, Greenville, SC (US); Duncan Jackson, Chicago, IL (US); Aidan Jamison, Brooklyn, NY (US); Andrew Black, Chicago, IL (US); Niels Denekamp, Chicago, IL (US); Eoin Billings, London (GB)

(73) Assignee: Hubbell Incorporated, Shelton, CT (US)

( * ) Notice: Subject to any disclaimer, the term of this patent is extended or adjusted under 35 U.S.C. 154(b) by 238 days.

(21) Appl. No.: 14/719,550

(22) Filed: May 22, 2015

(65) Prior Publication Data

US 2015/0338053 A1 Nov. 26, 2015

Related U.S. Application Data

(60) Provisional application No. 62/002,653, filed on May 23, 2014, provisional application No. 62/088,253, filed on Dec. 5, 2014.

(51) Int. Cl.

| | |
|---|---|
| ***F21V 5/02*** | (2006.01) |
| ***F21V 17/00*** | (2006.01) |
| ***F21K 99/00*** | (2016.01) |
| ***F21V 23/00*** | (2015.01) |
| ***F21S 8/06*** | (2006.01) |

(Continued)

(52) U.S. Cl.

CPC ..... *F21V 5/02* (2013.01); *F21S 8/061* (2013.01); *F21V 15/015* (2013.01); *F21V 17/00* (2013.01); *F21V 23/003* (2013.01); *F21V 3/02* (2013.01); *F21V 23/0442* (2013.01);

(Continued)

(58) Field of Classification Search

CPC ..... F21Y 2115/10; F21Y 2105/12; F21Y 2105/16

See application file for complete search history.

(56) References Cited

U.S. PATENT DOCUMENTS

| | | | |
|---|---|---|---|
| D131,532 | S | 3/1942 | Naysmith |
| D136,797 | S | 12/1943 | Mareck |

(Continued)

OTHER PUBLICATIONS

PCT/US2015/032121 International Search Report and Written Opinion dated Oct. 28, 2015.

*Primary Examiner* — Elmito Breval

(74) *Attorney, Agent, or Firm* — Michael Best & Friedrich, LLP

(57) ABSTRACT

A luminaire includes a support, a lens, an LED sheet, a top cover, a driver, an end bracket, and an end cap. The lens is connected to the support. The LED sheet is connected to the support between the lens and the support. The LED sheet has a plurality of LEDs, wherein a first LED is positioned in a first direction and a second LED is positioned in a second direction different from said first direction. The top cover is connected to the support. The driver is positioned in the support and electrically connected to the plurality of LEDs. The end bracket is connected to the support and the end cap is connected to the support covering the end bracket.

20 Claims, 37 Drawing Sheets

(51) Int. Cl.

| | |
|---|---|
| ***F21V 15/015*** | (2006.01) |
| *F21V 23/04* | (2006.01) |
| *F21V 3/02* | (2006.01) |
| *F21Y 105/16* | (2016.01) |
| *F21Y 105/12* | (2016.01) |
| *F21Y 115/10* | (2016.01) |

(52) U.S. Cl.
CPC ..... *F21Y 2105/12* (2016.08); *F21Y 2105/16* (2016.08); *F21Y 2115/10* (2016.08)

(56) References Cited

U.S. PATENT DOCUMENTS

| | | | | |
|---|---|---|---|---|
| 2,474,308 | A | 11/1949 | Franck et al. | |
| 2,874,271 | A | 6/1953 | Lipscomb | |
| 4,262,326 | A | 4/1981 | Lewin | |
| 4,876,633 | A | 10/1989 | Engel | |
| D418,626 | S | 1/2000 | Herst et al. | |
| D426,338 | S | 6/2000 | Herst et al. | |
| D452,030 | S | 12/2001 | Collver | |
| D461,923 | S | 8/2002 | Chelf | |
| 6,428,183 | B1 | 8/2002 | McAlpin | |
| D466,244 | S | 11/2002 | Lewis et al. | |
| 6,802,626 | B2 * | 10/2004 | Belfer | F21V 19/0085 362/219 |
| 6,962,428 | B2 | 11/2005 | Natsume | |
| D599,051 | S | 8/2009 | Wu et al. | |
| D608,042 | S | 1/2010 | Wu et al. | |
| 7,740,366 | B2 | 6/2010 | Tetsuo et al. | |
| 7,766,505 | B2 | 8/2010 | Tseng et al. | |
| 7,857,482 | B2 * | 12/2010 | Reo | F21V 5/008 362/225 |
| D633,642 | S | 3/2011 | Wauters | |
| 8,002,446 | B1 | 8/2011 | Plunk et al. | |
| 8,042,971 | B2 | 10/2011 | Medendorp, Jr. et al. | |
| 8,092,040 | B2 | 1/2012 | Wu et al. | |
| 8,092,041 | B2 | 1/2012 | Fowler, Jr. et al. | |
| D661,833 | S | 6/2012 | Imajo et al. | |
| 8,232,724 | B2 | 7/2012 | Mostoller et al. | |
| 8,262,250 | B2 * | 9/2012 | Li | F21V 17/007 362/219 |
| 8,425,085 | B2 | 4/2013 | Van Laanen et al. | |
| 8,414,154 | B2 | 9/2013 | Dau et al. | |
| 2003/0223235 | A1 * | 12/2003 | Mohacsi | F21S 2/00 362/240 |
| 2009/0284988 | A1 | 11/2009 | Snagel et al. | |
| 2011/0199767 | A1 | 8/2011 | Marquardt et al. | |
| 2011/0285314 | A1 | 11/2011 | Carney et al. | |
| 2011/0286207 | A1 * | 11/2011 | Chan | F21V 15/013 362/217.1 |
| 2013/0039041 | A1 | 2/2013 | Yeh et al. | |
| 2013/0063934 | A1 * | 3/2013 | Vermeland | F21V 31/005 362/217.05 |
| 2013/0182422 | A1 * | 7/2013 | Guilmette | F21V 21/00 362/184 |
| 2013/0201690 | A1 | 8/2013 | Vissenberg et al. | |
| 2013/0294053 | A1 | 11/2013 | Marquardt et al. | |
| 2013/0294059 | A1 | 11/2013 | Galluccio et al. | |
| 2014/0028210 | A1 * | 1/2014 | Maxik | F21V 23/06 315/200 R |
| 2015/0345743 | A1 * | 12/2015 | Trincia | F21V 7/0091 362/223 |
| 2015/0362132 | A1 * | 12/2015 | McCane | F21K 9/90 362/235 |
| 2016/0053973 | A1 * | 2/2016 | Tress | F21S 4/28 362/217.02 |

* cited by examiner

LUMINAIRE

RELATED APPLICATIONS

The present application claims priority to U.S. Provisional Applications 62/002,653, filed on May 23, 2014, and 62/088,253, filed on Dec. 5, 2014, the disclosures of which are hereby incorporated by reference in their entirety.

FIELD OF THE INVENTION

Various exemplary embodiments of the invention relate to luminaires, for example indoor luminaire.

BACKGROUND OF THE INVENTION

Luminaires, or light fixtures, are used with electric light sources to provide aesthetic and functional housing in both interior and exterior applications. Various types of interior luminaires include overhead, ceiling, or suspended luminaires, which are designed to be positioned near, or suspended from, the ceiling. Interior luminaires are typically made with either direct or indirect lighting elements. In recent years, lighting applications have trended towards the use of light emitting diodes (LEDs) as the light source in place of conventional incandescent and fluorescent lamps.

SUMMARY

According to an exemplary embodiment, a luminaire includes a support, a lens, an LED sheet, a top cover, a driver, an end bracket, and an end cap. The lens is connected to the support. The LED sheet is connected to the support between the lens and the support. The LED sheet has a plurality of LEDs, wherein a first LED is positioned in a first direction and a second LED is positioned in a second direction different from said first direction. The top cover is connected to the support. The driver is positioned in the support and electrically connected to the plurality of LEDs. The end bracket is connected to the support and the end cap is connected to the support covering the end bracket.

According to another exemplary embodiment, a luminaire includes a first support having an open first end. A first lens is connected to the first support. A second support has an open second end and a second lens is connected to the second support. A joiner rail is connected to the open first end of the first support and the open second end of the second support.

According to another exemplary embodiment, a luminaire includes a support, a lens, a light element, a tray, and a control component. The lens is connected to the support. The light element is positioned between the support and the lens. The tray is connected to the support and a control component is received in the tray.

BRIEF DESCRIPTION OF THE DRAWINGS

The aspects and features of various exemplary embodiments will be more apparent from the description of those exemplary embodiments taken with reference to the accompanying drawings, in which:

FIG. 101 is a perspective view of a side cover for use with the luminaire of FIG. 98 according to an exemplary embodiment;

FIG. 102 is a front view of a light rail according to another exemplary embodiment;

FIG. 102A is an enlarged view of the area A of FIG. 102;

FIG. 103 is a front view of a lens according to another exemplary embodiment;

FIG. 103A is an enlarged view of the area A of FIG. 103; and

FIG. 103B is an enlarged view of the area B of FIG. 103.

DETAILED DESCRIPTION OF EXEMPLARY EMBODIMENTS

Figure 1:
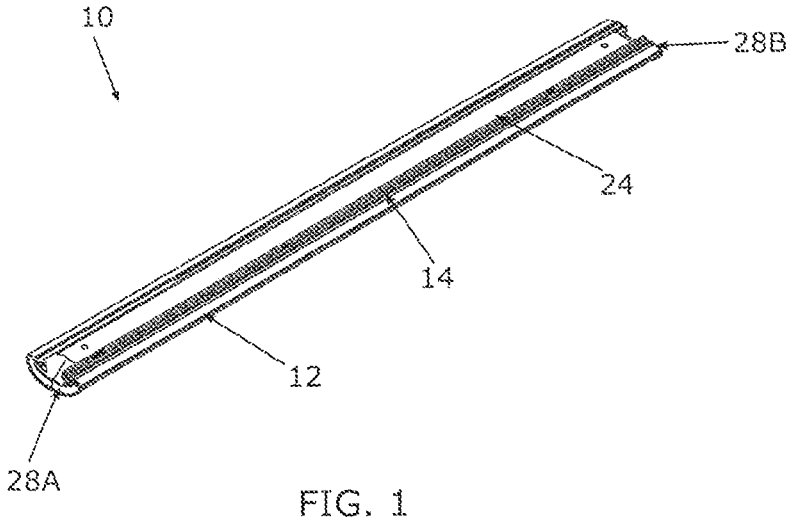
FIG. 1 is a perspective view of a luminaire according to a first exemplary embodiment.

According to various exemplary embodiments as illustrated in one or more of the drawings, a luminaire 10 includes a lens 12 connected to a support, for example a light rail 14. A flexible light emitting diode (LED) sheet 16 is connected to the light rail 14 and positioned between the light rail 14 and the lens 12. A driver 18 is positioned on the light rail 14 and connected by one or more driver brackets 20. The driver 18 is electrically connected to the LED sheet 16. A grounding bracket 22 electrically grounds the driver 18 to the light rail 14. A top cover 24 is connected to the light rail 14 over the driver 18. First and second side covers 26A, 26B are connected to the light rail 14 to enclose the sides of the driver. First and second end caps 28A, 28B are connected to the light rail 14 to enclose the sides of the light rail 14 and lens 12.

Figure 3:
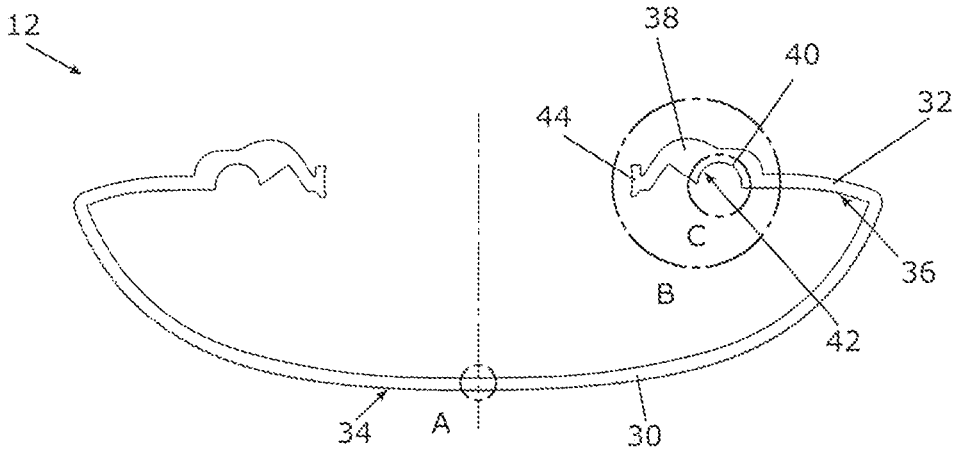
FIG. 3 is a front view of the lens of FIG. 2.
Figure 3A:
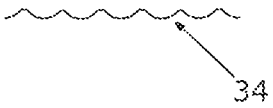
FIG. 3A is an enlarged front view of section A of FIG. 3.

As best shown in FIG. 3, and in accordance with further exemplary embodiments, the lens 12 includes a bottom section 30 and first and second top sections 32. In various exemplary embodiments, the lens 12 is made from a polymer material, for example acrylic, and is extruded to any desired length. In alternative embodiments, other materials and methods of manufacture may be used. The bottom section 32 has a concave curve extending to a first and second corner. The bottom section 32 includes an outer surface having a plurality of prisms 34. The term prism is used herein not to describe a specific structure, but to refer to a feature for directing, dispersing, diffusing, or otherwise modifying emitted light. According to an exemplary embodiment, the prisms 34 are rounded prisms as shown, for example, in FIG. 3A. The size, shape, spacing, and configuration of the prisms 34 can vary depending on the desired light output.

Figure 3B:
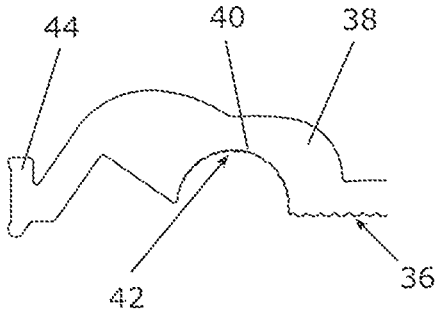
FIG. 3B is an enlarged front view of section B of FIG. 3.
Figure 3C:
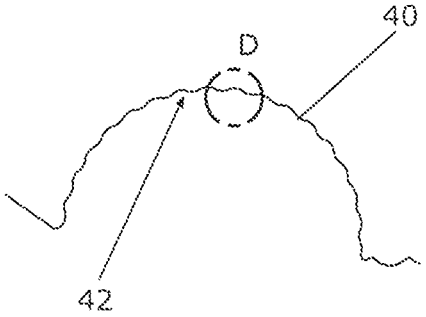
FIG. 3C is an enlarged front view of section C of FIG. 3.
Figure 3D:
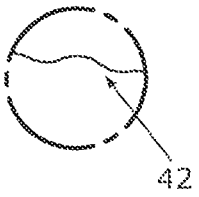
FIG. 3D is an enlarged front view of section D of FIG. 3C.
Figure 4:
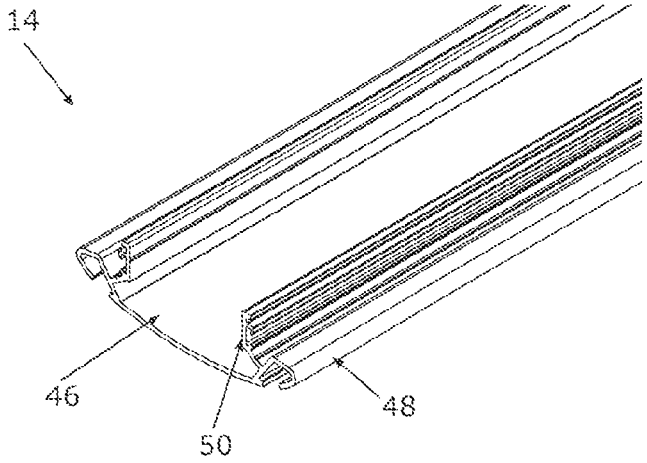
FIG. 4 is a perspective view of the light rail of FIG. 2.
Figure 5:
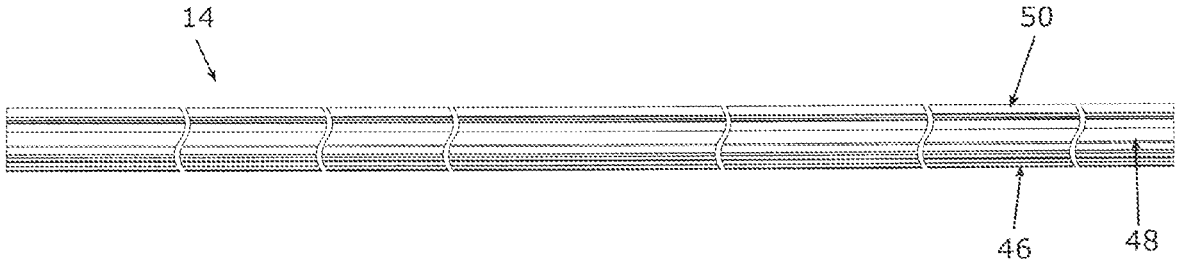
FIG. 5 is a right side view of the light rail of FIG. 4.
Figure 6:
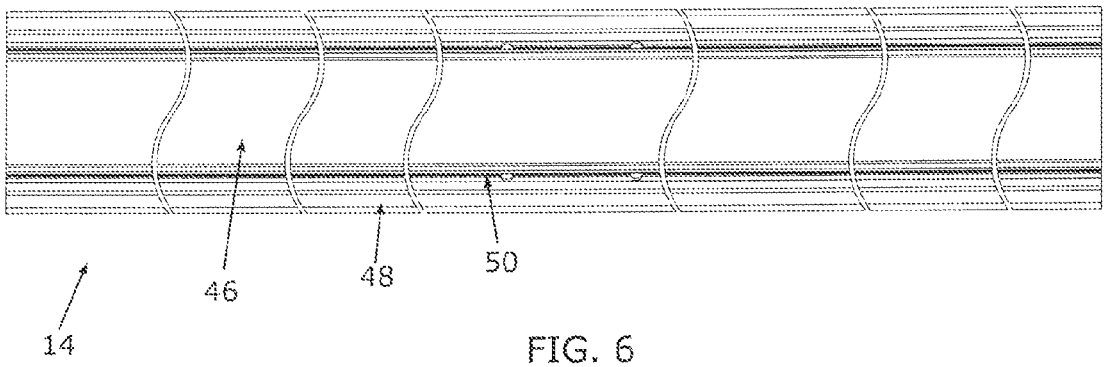
FIG. 6 is a top view of the light rail of FIG. 4.

The first and second top sections 32 extend from the bottom section 30 towards the center of the lens 12. A first set of prisms 36 extends from the inner surface of the first and second top sections 32. A first and second arm 38 extend from the first and second top sections 32, respectively. According to the exemplary embodiment, the first and second arms 38 include various curvilinear and rectilinear inner and outer surfaces as shown in FIG. 3B. First and second cylindrical grooves 40 extend into the first and second arms 38, respectively. A plurality of prisms 42 extend from the inner surface of the grooves 40. According to an exemplary embodiment, the prisms 36 extending from the first and second top sections and the prisms 42 extending from the cylindrical grooves 40 are rounded prisms as shown in FIGS. 3B-3D. The size, shape, spacing, and configuration of the prisms 36, 42 can vary depending on the desired light output. A first flange 44 and a second flange extend from the first and second arms 38, respectively.

Figure 7:
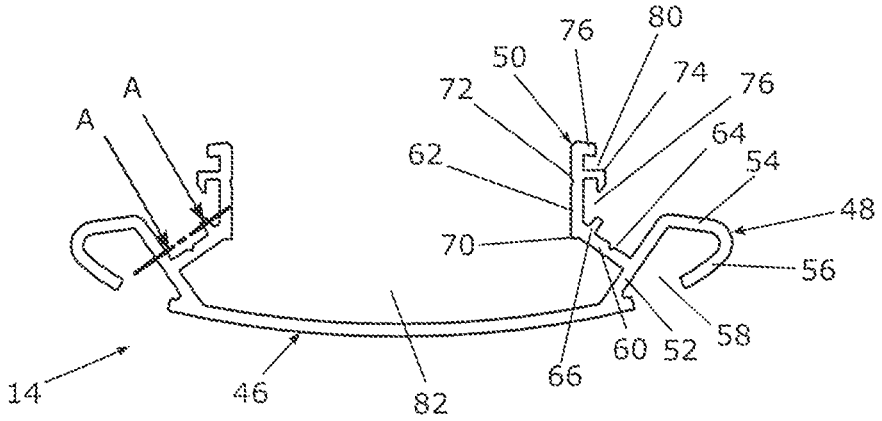
FIG. 7 is a front view of the light rail of FIG. 4.

As best shown in FIGS. 4-7A, and in accordance with further exemplary embodiments, the support or light rail 14 includes a bottom portion 46, first and second side hooks 48, and first and second arms 50 extending form the side hooks 48. In various exemplary embodiments, the light rail 14 is made from metal, for example aluminum, and is extruded to any desired length. In alternative embodiments, other materials and methods of manufacture may be used. Various exemplary embodiments of the light rail 14 have the capability to flex or bow a certain amount depending on the luminaire configuration. As best shown in FIG. 7, the bottom portion 46 has a concave curve extending to a first end and a second end. The hooks 48 extend from the bottom section proximate the first and second ends. The first and second arms 50 extend from the first and second hooks 48. Both sides of the light rail 14 have similar configurations and only one side may be described herein for clarity.

According an exemplary embodiment, the hooks 48 have a substantially planar first section 52 extending from the bottom portion 46 at an oblique angle away from the center of the light rail 14, a substantially planar second section 54 extending from the first section 52 at an oblique angle away from the center of the light rail 14, and a curved third section 56 curving from the second section 54 downwardly and back towards the center of the light rail 14. The first and second hooks 48 bound a first and second hook channel 58, respectively, with the free end of the first and second hooks 48 spaced from the bottom section 46 to define an opening.

Figure 7A:
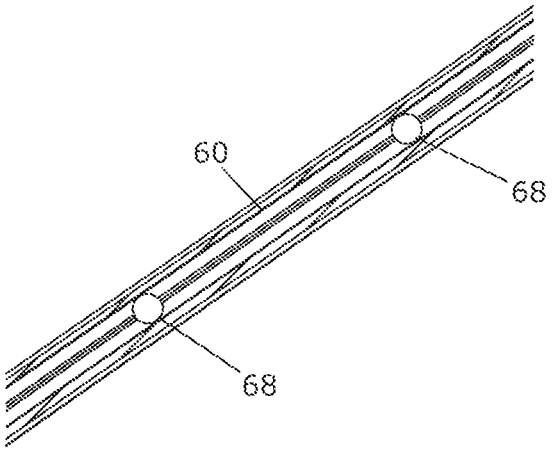
FIG. 7A is a partial, sectional view of FIG. 7 taken along line A-A and viewed in direction of the arrows.

The first and second arms 50 include a first portion 60 and a second portion 62. In various exemplary embodiments, the first portion 60 of the first and second arms 50 extends from the first section 52 of the first and second hooks 48 at an oblique angle towards the center of the light rail 14. Each of the first portions 60 include a first notch 64 extending into an outer surface and first protrusions 66 extending outwardly from the outer surface. As best shown in FIG. 7A, the first portions 60 include one or more openings 68, for example wireway or alignment openings. In various exemplary embodiments, the second portions 62 extend outwardly from the respective first portions 60 with a substantially vertical orientation. A first end of the second portions extends below the first portion to form a lip 70. Each of the second portions 62 include a second notch 72 formed into an inner surface, outwardly facing second protrusions 74 having an angled prong extending from an outer surface, and outwardly extending third protrusions 76 extending from the outer surface. The first and second protrusions 66, 74 bound a first side channel 78 and the second and third protrusions 74, 76 bound a second side channel 80. The light rail bottom 46, first and second hooks 48, and first and second arms 50 bound a center channel 82.

Figure 8:
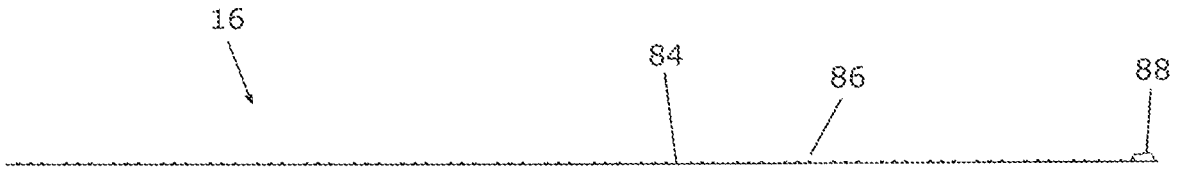
FIG. 8 is a right side view of the light sheet of FIG. 2.
Figure 9:
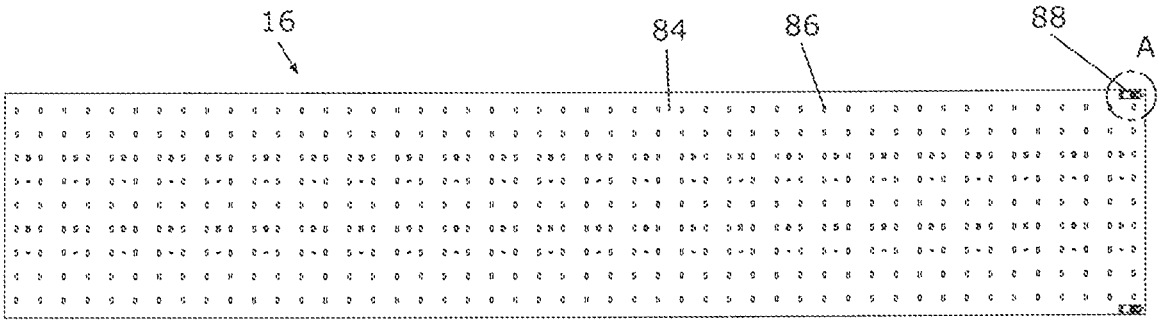
FIG. 9 is a top view of the light sheet of FIG. 8.
Figure 9A:
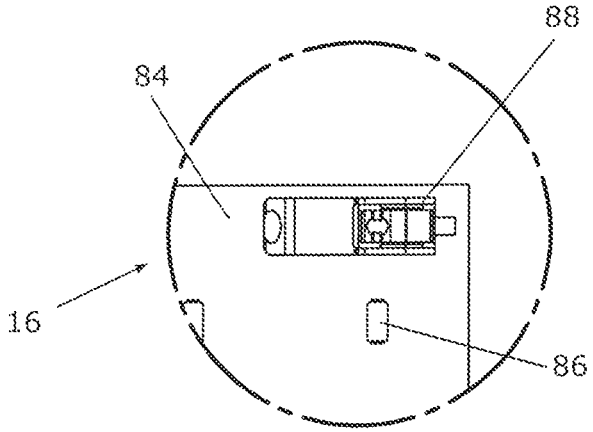
FIG. 9A is an enlarged view of section A of FIG. 9.

As best shown in FIGS. 8-9A, and in accordance with further exemplary embodiments, the LED sheet 16 includes a sheet of flexible material 84 with a plurality of LEDs. In various exemplary embodiments, the LEDs are LED modules 86 that are contained units having a dome-shaped lens surrounding one or more light generating elements and necessary circuitry (not shown). Various types of LED modules 86 may be used depending on the performance requirements and the desired output as would be understood by one of ordinary skill in the art. The LED modules 86 extend from a single surface of the flexible material 84. According to an exemplary embodiment, the flexible material 84 is a polymer or composite sheeting or other suitable material having one or more layers, for example, two layers of polymer sheeting sandwiching conductor pathways and LED modules 86.

As shown in FIG. 9, the LED modules 86 are arranged in different patterns, for example, an outer pattern and an inner pattern. In various exemplary embodiments, the outer most rows of LED modules 86 on each side of the LED sheet 16 are configured for up-lighting or indirect lighting, while the remaining LED modules 86 are configured for down-lighting or direct lighting.

Connectors 88 are positioned at first and second corners of the LED sheet. The connectors 88 are electrically connected to one or more drivers 18, for example through a conductor. Multiple paths or traces electrically connect the connectors 88 to the plurality of LED modules 86. In various exemplary embodiments, the connectors 88 are surface mount terminal block type connectors. The connectors 88 can be configured to connect to one or more similar or identical connectors, for example through conductors or connecting links, so that multiple LED sheets 16 can be connected together as desired.

Figure 2:
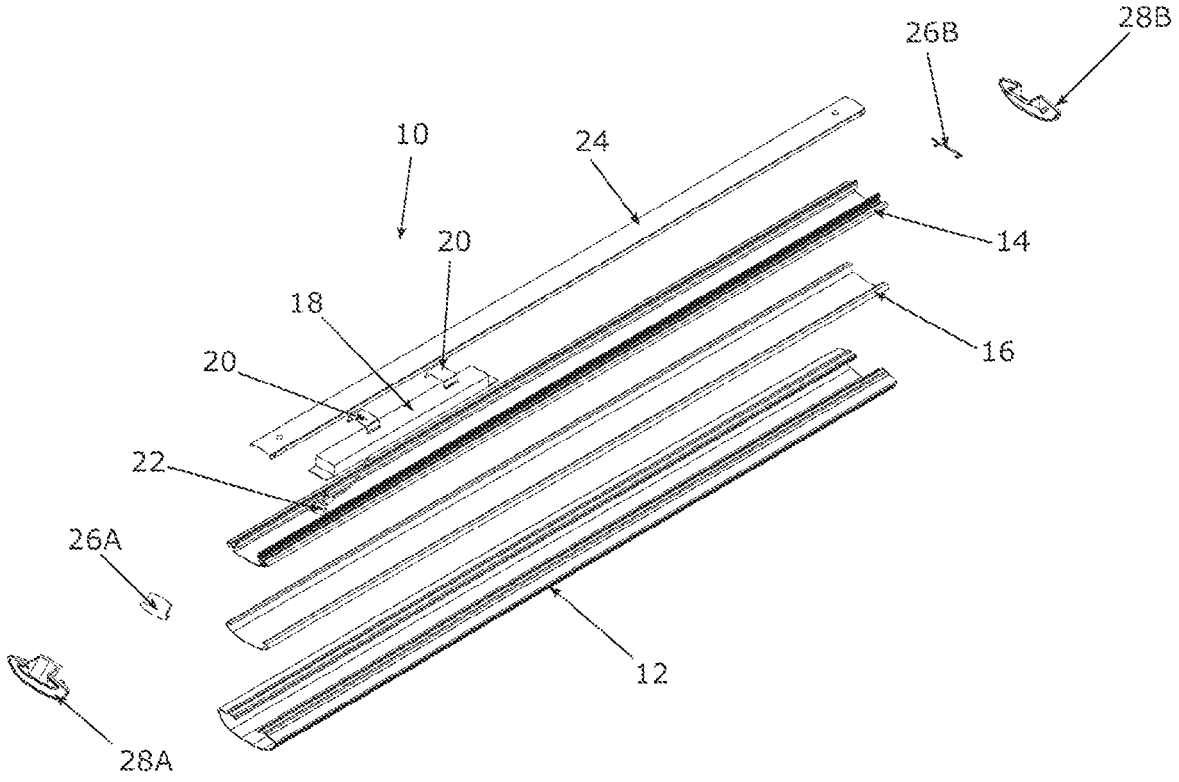
FIG. 2 is an exploded, perspective view of the luminaire of FIG. 1.
Figure 10:
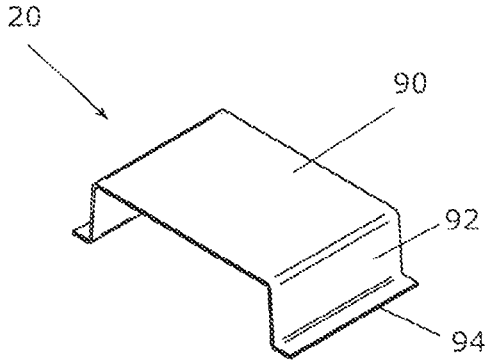
FIG. 10 is a perspective view the driver bracket of FIG. 2.
Figure 11:
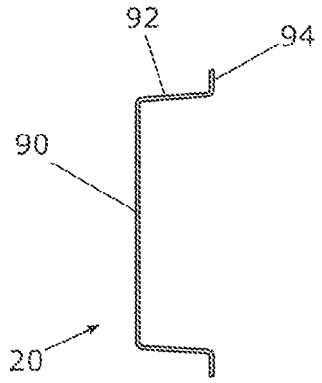
FIG. 11 is a front view of the driver bracket of FIG. 10.

As best shown in FIG. 2, and in accordance with further exemplary embodiments, the driver 18 is connected to the light rail 14 through one or more driver brackets 20. An exemplary embodiment of the driver bracket 20 is shown in FIGS. 10 and 11. The driver bracket 20 has a substantially U-shaped body with a top section 90, first and second side sections 92, and first and second flanges 94 extending from the first and second side sections 92, respectively. In various exemplary embodiments, the driver bracket 20 is made from metal, for example stainless steel, although in alternative embodiments, other materials may be used.

Figure 12:
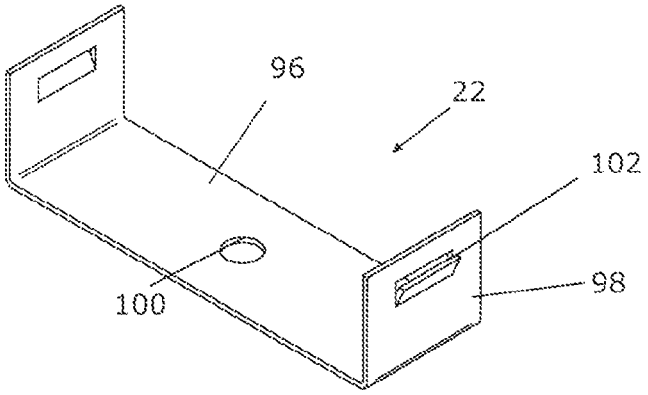
FIG. 12 is a perspective view of the grounding bracket of FIG. 2.
Figure 13:
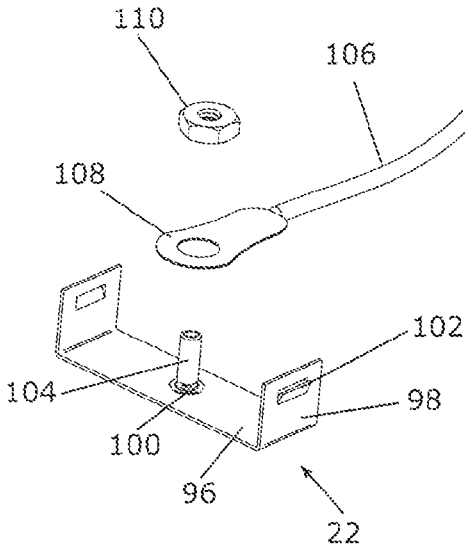
FIG. 13 is an exploded, perspective view of the grounding bracket and ground wire of FIG. 2.
Figure 14:
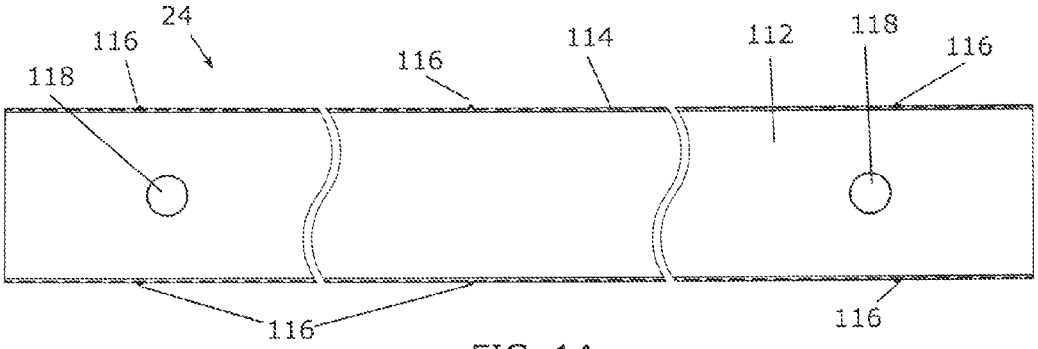
FIG. 14 is a top view of the top cover of FIG. 2.
Figure 15:
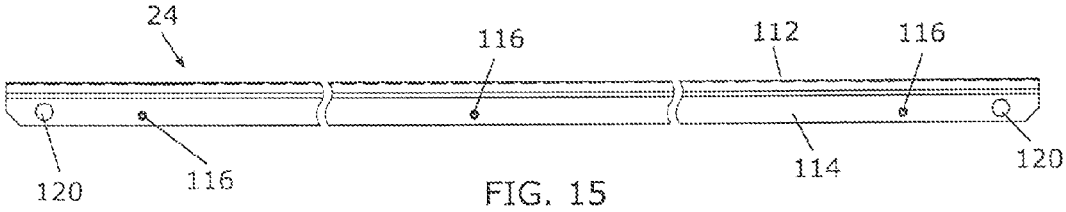
FIG. 15 is a right side view of the top cover of FIG. 14.
Figure 16:
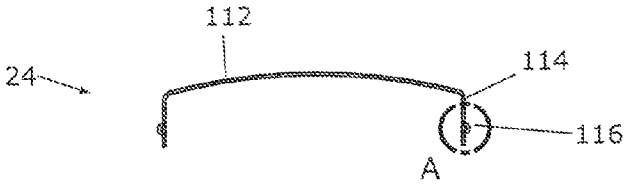
FIG. 16 is a front view of the top cover of FIG. 14.
Figure 16A:
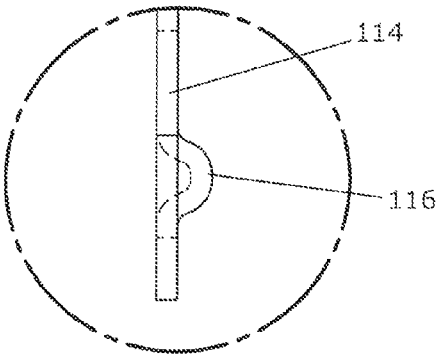
FIG. 16A is an enlarged view of area A of FIG. 16.

The driver 18 is grounded to the light rail 14 through a grounding bracket 22. According to the exemplary embodiment shown in FIGS. 12 and 13 the grounding bracket 22 is substantially U-shaped having a bottom section 96 and first and second sides 98 extending upwardly from the bottom section 96. In various exemplary embodiments, the grounding bracket 22 is made from metal, for example stainless steel, although in alternative embodiments, other materials may be used. The bottom section 96 includes an aperture 100 and the first and second sidewalls each include an outwardly extending tine 102.

According to an exemplary embodiment, the grounding bracket 22 is positioned on the light rail 14 with a post 104 extending through the aperture 100. A grounding wire 106 having an eyelet 108 extends from the driver 18 and is positioned on the post 104 and secured thereto. In various exemplary embodiments, the post 104 is threaded and a nut no is fastened to the post 104 to secure the grounding wire 106. In other embodiments, the grounding wire 106 may be soldered to the post 104.

As best shown in FIGS. 14-16A, and in accordance with further exemplary embodiments, the cover 24 is substantially U-shaped with a curved top surface 112 and first and second sides 114 extending downwardly from the top surface 112. The first and second sides 112 include one or more protrusions 116 extending from an outer surface away from the center of the cover 24. The protrusions 116 may be formed through pressing, stamping, or punching the first and second sides to form rounded deformations therein. One or more top apertures 118 extend through the top of the cover 24 and one or more side apertures 120 extending through the sides of the cover 24. In various exemplary embodiments, the cover 24 is made from metal, for example aluminum, and is extruded to any desired length. In alternative embodiments, other materials and methods of manufacture may be used.

A driver 18 can be positioned in the light rail 14 center channel 82 and one or more driver brackets 20 are positioned over the driver 18 and connected to the light rail 14, for example through engagement of the driver bracket 20 flange 94 and the lip 70 formed between the first and second portions 60, 62 of the first and second arms 50. The driver bracket 20 may be slidable connected or snap fit to the light rail 14. Also, the grounding bracket 22 is connected to the light rail 14 center channel 82, for example through engagement of the tines 102 and the lip 70 formed between the first and second portions 60,62 of the first and second arms 50. The grounding bracket 22 may be slidable connected or snap fit to the light rail 14. The top cover 24, shown in the exemplary embodiment of FIGS. 14-16A, is connected to the light rail 14 by engagement of the protrusions 116 with the second notches 72 formed in the second portions 62 of the light rail 14 first and second arms 50. The top cover 24 may be slidable connected to snap fit to the light rail 14.

Figure 17:
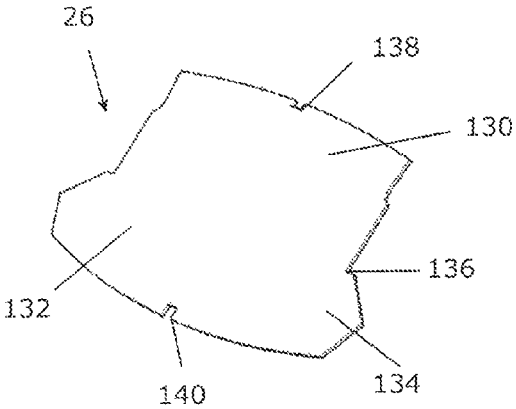
FIG. 17 is a perspective view of the side cover of FIG. 2.
Figure 18:
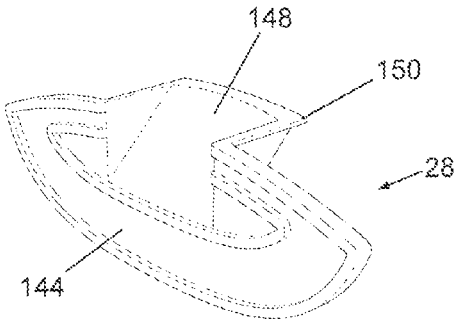
FIG. 18 is a front perspective view of the end cap of FIG. 2.
Figure 19:
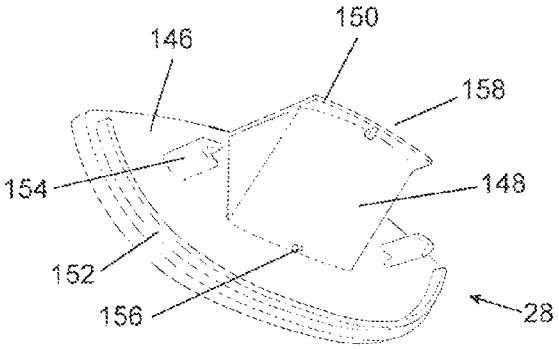
FIG. 19 is a rear perspective view of the end cap of FIG. 18.
Figure 20:
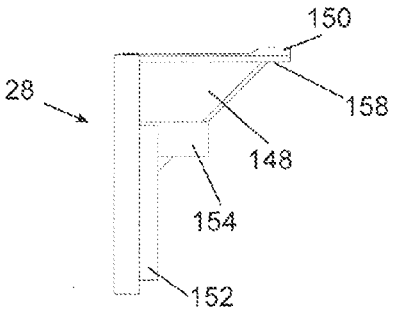
FIG. 20 is a right side view of the end cap of FIG. 18.
Figure 21:
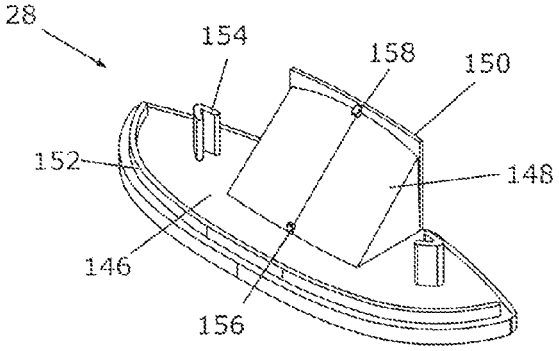
FIG. 21 is another rear perspective view of the end cap of FIG. 18.
Figure 22:
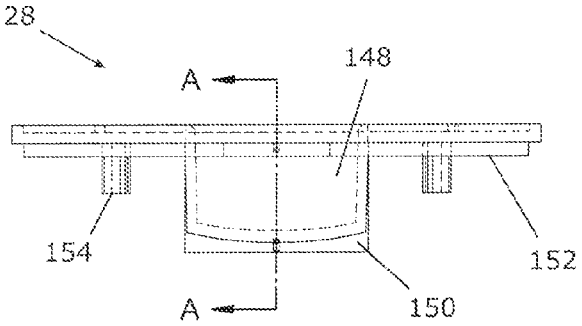
FIG. 22 is a bottom view of the end cap of FIG. 18.
Figure 22A:
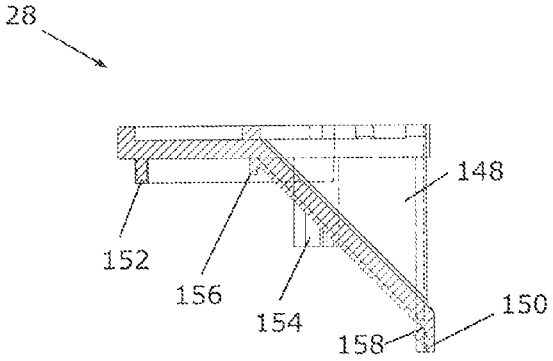
FIG. 22A is a right side sectional view of FIG. 22 taken along line A-A and viewed in direction of the arrows.

FIG. 17 shows an exemplary embodiment of a side cover 26 having a top section 130 and a bottom section 132. In various exemplary embodiments, the side 26 cover is configured to mate with the light rail 14 shown in FIGS. 3-6. The bottom section 132 has first and second shoulders 134 that are wider than the top section and include at least one substantially horizontal edge 136. The shoulders 134 are designed to abut the lip 70 formed between the first and second portions 60, 62 of the first and second arms 50. One or more protursions (shown in FIG. 1A) may extend from the bottom section 132 to position the side cover 26 on the light rail 14. The first side cover 26 includes a top slot 138 and a bottom slot 140 for mating with an end cap 28.

FIGS. 18-22A show an exemplary end cap 28. The end cap 28 includes a front surface 144 and a rear surface 146. The front surface 144 has an angled wall 148 extending away from the front surface 144. Extending from the angled wall 148 is a top flange 150. A bottom flange 152 extends from the rear surface 146. First and second mounting posts 154 extend from the rear surface 146 and have a substantially sideways V-shape with a rounded corner. A first tab 156 and a second tab 158 extend from the angled wall 148. In various exemplary embodiments, the end cap 28 is translucent to allow light emitted from the luminaire to diffuse through the ends. In other alternative embodiments, the end cap 28 is opaque or has a varying degree of opacity.

Figure 23:
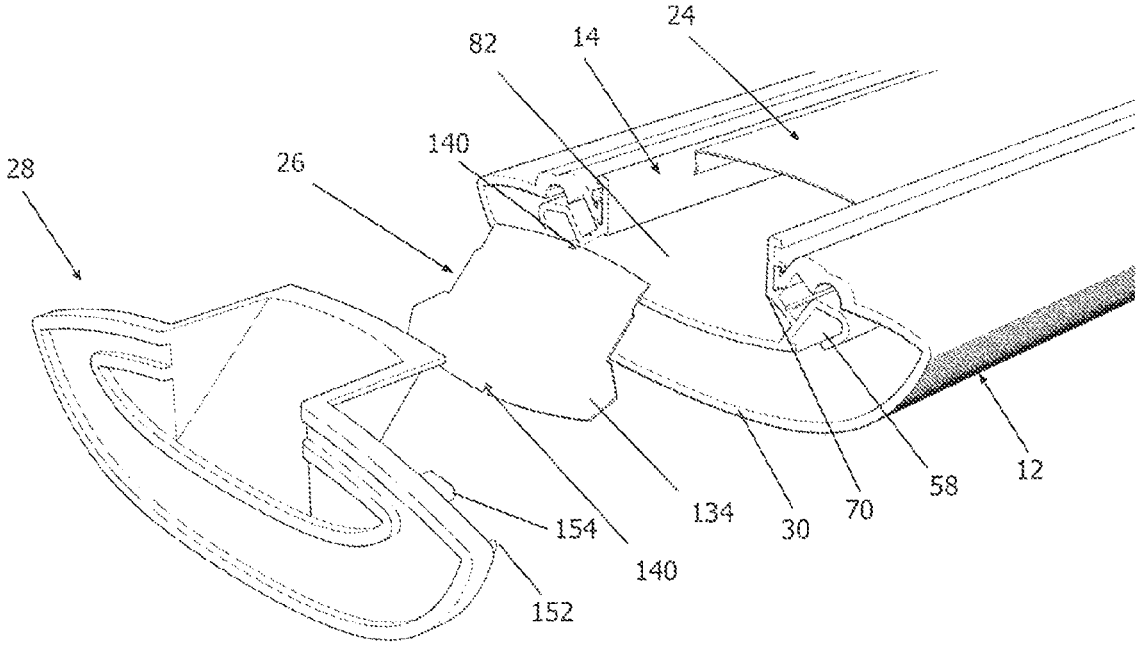
FIG. 23 is a perspective, partially exploded view of a luminaire according to an exemplary embodiment.
Figure 24:
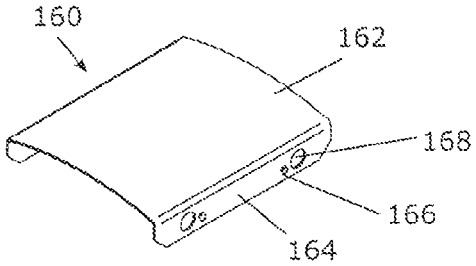
FIG. 24 is a perspective view of an extending cover according to an exemplary embodiment.
Figure 25:
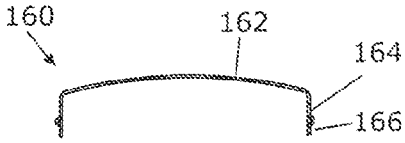
FIG. 25 is a front view of the extending cover of FIG. 24.
Figure 26:
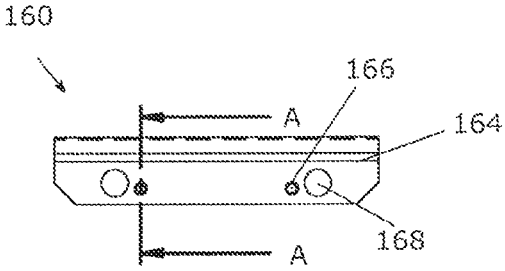
FIG. 26 is a right side view of the extending cover of FIG. 24.
Figure 26A:
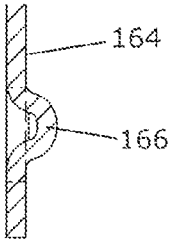
FIG. 26A is an enlarged sectional view of FIG. 26 taken along line A-A and viewed in direction of the arrows.
Figure 27:
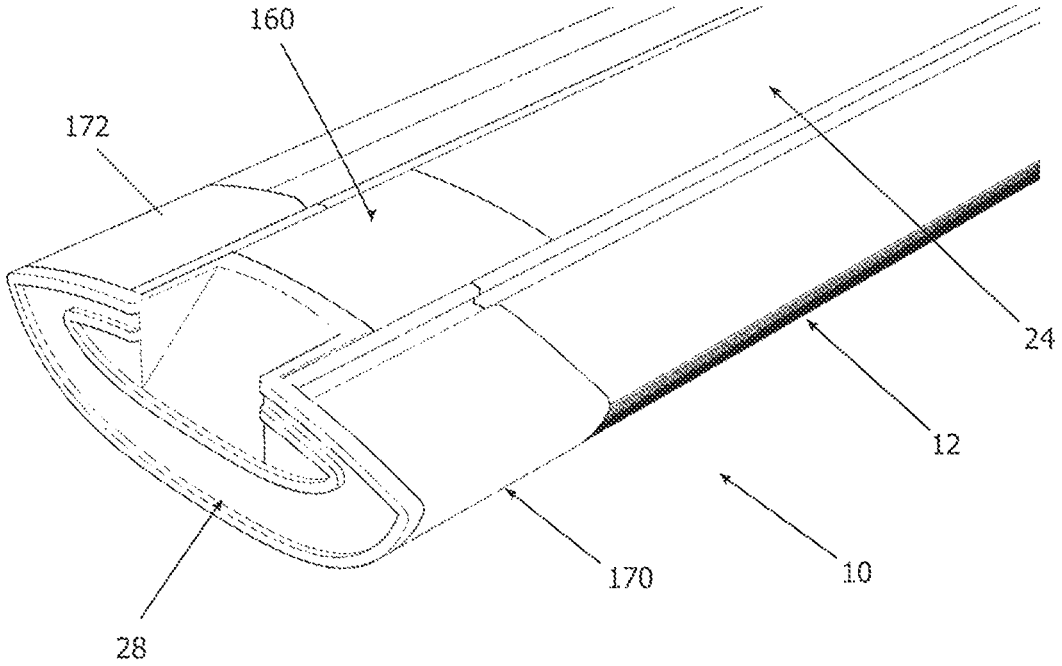
FIG. 27 is a top perspective view of a luminaire and a sensor module according to an exemplary embodiment.
Figure 28:
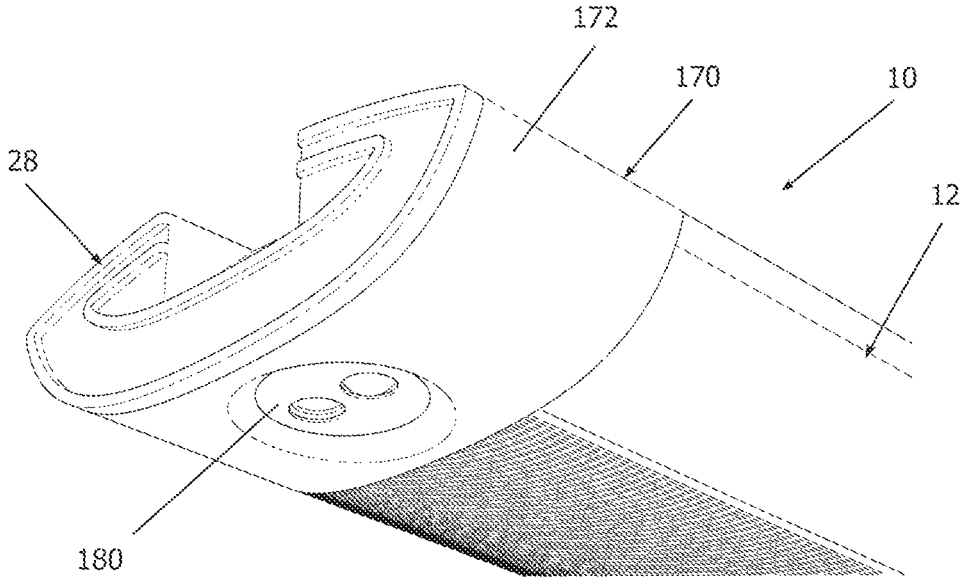
FIG. 28 is a bottom perspective view of the luminaire and sensor module of FIG. 27.
Figure 29:
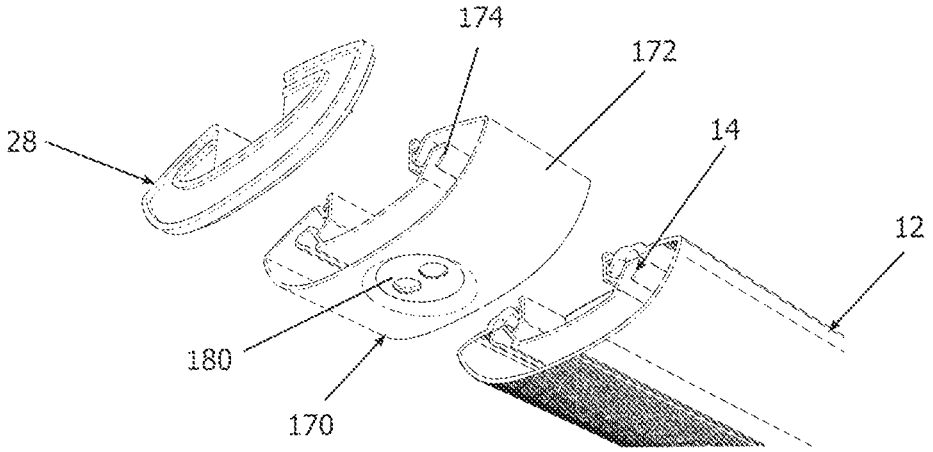
FIG. 29 is an exploded, bottom perspective view of the luminaire and sensor module of FIG. 27.
Figure 30:
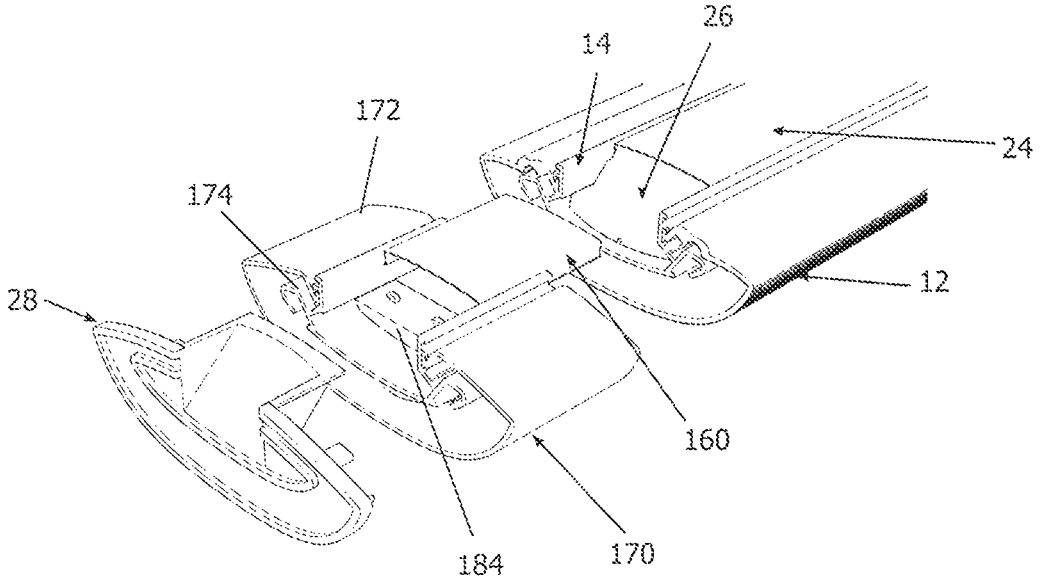
FIG. 30 is an exploded, top perspective view of the luminaire and sensor module of FIG. 27.

FIG. 23 shows the exemplary side cover 26 and the exemplary end cap 28 being inserted into the light rail 14. The side cap 26 is slid into the center channel 82 of the light rail 14 so that the shoulder abuts 134 or fits inside the lip 70. The end cap 28 is then inserted so that the bottom flange 152 engages the inner surface of the of the bottom section 30 of the lens 12 and the first and second mounting posts 154 extend into the first and second hook channels 58, respectively. The first tab 156 of the end cap 28 engages the bottom slot 140 of the side cover 26 and the second tab 158 of the first end cap engages the top slot 138 of the side cover 26. The end cap top flange 150 is positioned over the light rail 14 and adjacent to, in direct contact with, or overlapping the top cover 24. Another end cap and side cover are connected to the opposite side of the light rail 14. The side covers 62 provide an enclosure for the driver 18.

In accordance with various exemplary embodiments, the luminaire 10 is modular and capable of connecting with other modules as discussed in further detail below. FIGS. 24-26A show an exemplary extending cover 160 for use with the luminaire 10. The extending cover 160 includes a curved top surface 162 and first and second sides 164 extending downwardly from the top surface 162. The first and second sides 164 include one or more protrusions 166 extending from an outer surface away from the center of the extending cover 160. The protrusions 166 may be formed through pressing, stamping, or punching the first and second sides 164 to form rounded deformations therein. One or more side apertures 168 extend through the sides 164 of the extending cover 160. In various exemplary embodiments, the extending cover 160 is made from metal, for example aluminum, and is extruded to any desired length. In alternative embodiments, other materials and methods of manufacture may be used.

As best shown in FIGS. 27-33, and in accordance with further exemplary embodiments, the extending cover 160 is used to connect a sensor module 170 to the luminaire 10. The sensor module 170 includes a sensor cover 172 connected to a sensor rail 174. In an exemplary embodiment, the sensor cover 172 has similar features to the lens 12 and the sensor rail 174 has similar features to the light rail 172. The extending cover 160 protrusions 166 connect to the second notch 72 on the light rail 14 and a similar inner notch 176 on the sensor rail 174.

Figure 31:
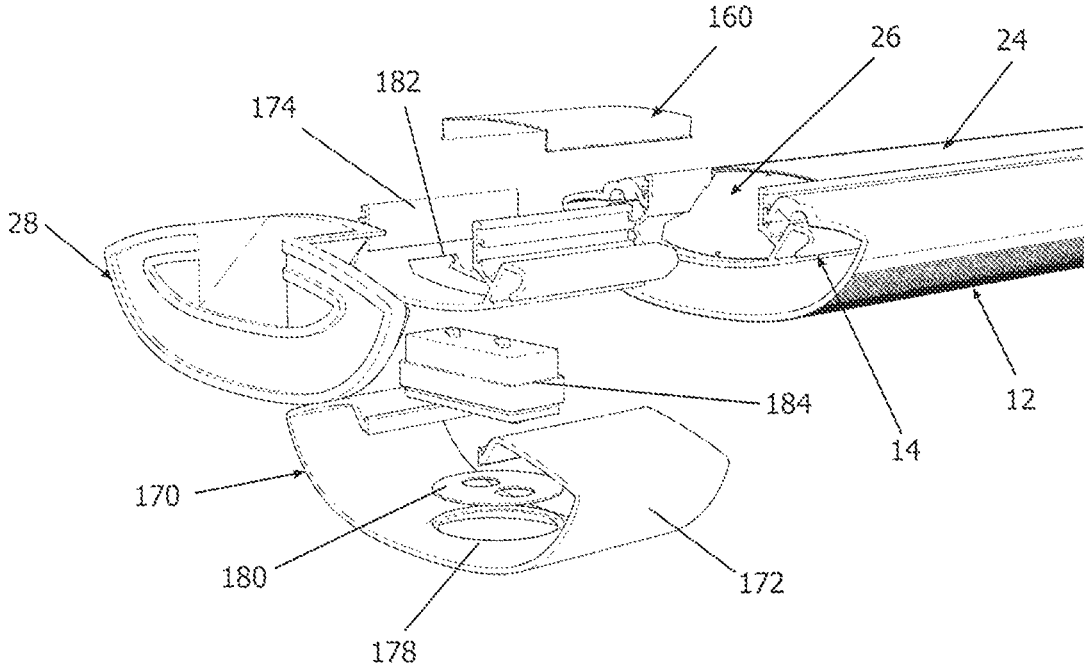
FIG. 31 is another exploded, perspective view of the luminaire and sensor module of FIG. 27.
Figure 32:
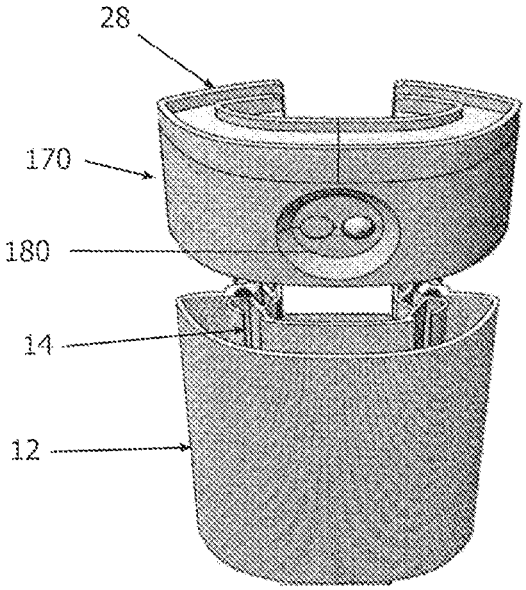
FIG. 32 is a bottom perspective view of a first sensor module used with the luminaire according to various exemplary embodiments.
Figure 33:
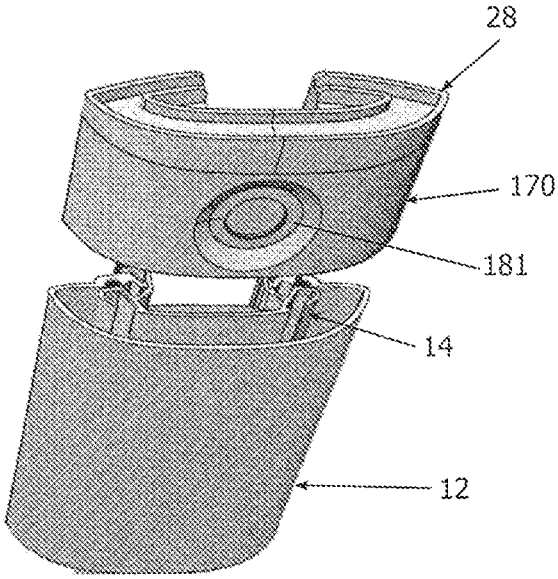
FIG. 33 is a bottom perspective view of a second sensor module used with the luminaire according to various exemplary embodiments.
Figure 34:
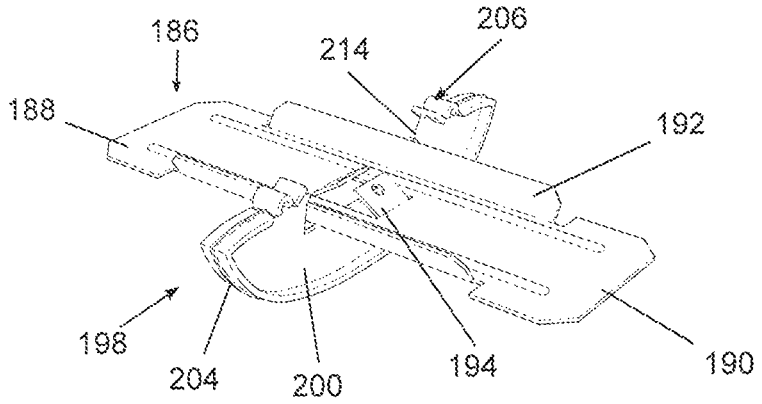
FIG. 34 is a perspective view of a connector plate and optical spacer according to an exemplary embodiment.
Figure 35:
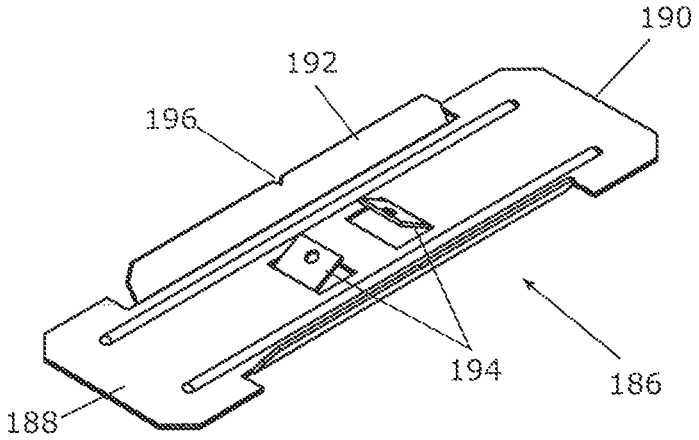
FIG. 35 is a perspective view of the connector plate of FIG. 34.
Figure 36:
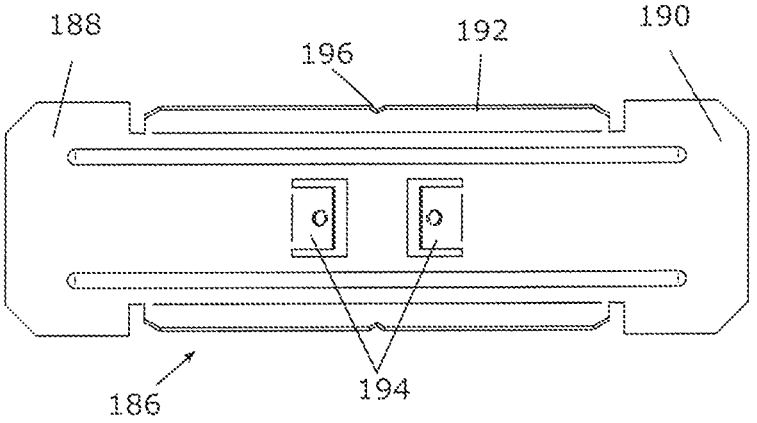
FIG. 36 is a top view of the connector plate of FIG. 35.
Figure 37:
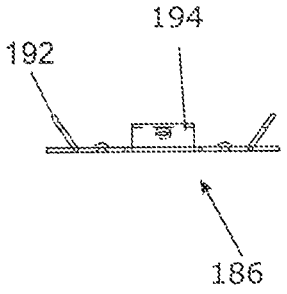
FIG. 37 is a front view of the connector plate of FIG. 35.
Figure 38:
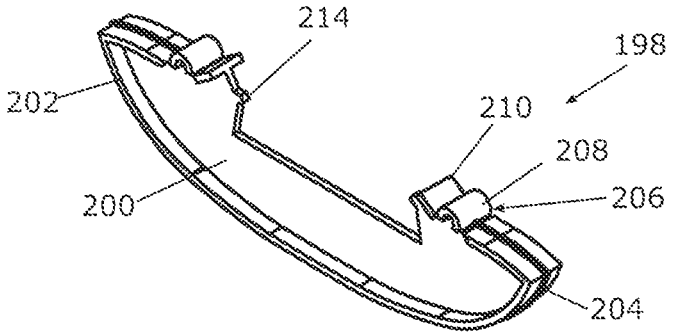
FIG. 38 is a perspective view of the optical spacer of FIG. 34.
Figure 39:
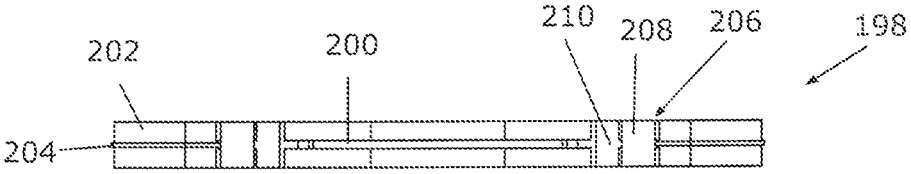
FIG. 39 is a top plan view of the optical spacer of FIG. 38.
Figure 40:
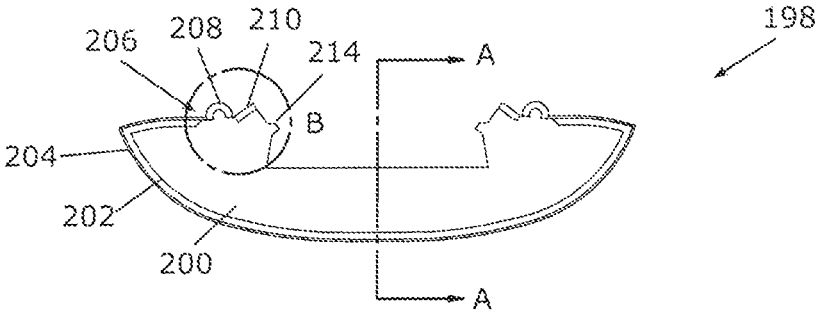
FIG. 40 is a front view of the optical spacer of FIG. 38.
Figure 40A:
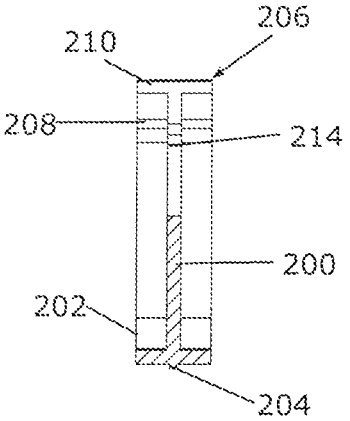
FIG. 40A is a sectional view of the optical spacer of FIG. 40 taken along line A-A and viewed in direction of the arrows.
Figure 40B:
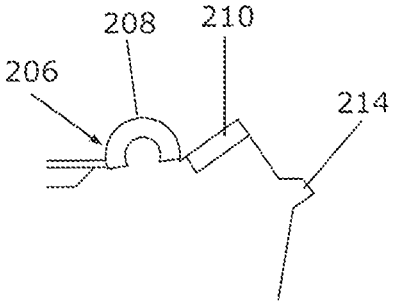
FIG. 40B is an enlarged view of the area B of FIG. 40.

As best shown in FIG. 31, the sensor cover 172 includes a first aperture 178, for example a circular opening, and an adapter plate 180 positioned in the aperture. The sensor rail 174 includes a second aperture 182, for example a substantially rectangular opening. A sensor 184 is positioned adjacent the first aperture 178 in the sensor cover 172 and extends through the second aperture 182 in the sensor rail 174. In the exemplary embodiment shown in FIGS. 29 and 32, the adaptor plate 180 includes two openings and can be used with a sensor 184 having more than one detection capability, or two integrated sensors. As best shown in FIGS. 31-33, and in accordance with further exemplary embodiments, the adaptor plate 180 is interchangeable with other adaptor plates, for example the adaptor plate 181 with a single opening, so that different types of sensors may be used with the same sensor module 170. Various types of exemplary sensors include, but are not limited to, infrared sensors, dimming photosensors, motion sensors, noise sensors, occupancy sensors, and daylight sensors.

In various exemplary embodiments, the extending cover 160 is used in connection with a connector plate 186 and an optical spacer 198 to connect multiple luminaries. As best shown in FIGS. 34-37, and in accordance with further exemplary embodiments, the connector plate 186 includes a first and second ends 188, 190, first and second side flanges 192, and first and second tines 194. The first and second side flanges 192 extend at an angle away from the center of the connector plate 186. The first and second tines 194 extend outwardly from a central region of the connector plate 186 and include an aperture for receiving a mechanical fastener, for example a set screw (not shown). In various exemplary embodiments, the first and second side flanges 192 and the first and second tines 194 are resilient. The first and second flanges 192 include a notch 196. In various exemplary embodiments, the connector is made from metal, for example galvanized steel, although other materials may be used.

As best shown in FIGS. 38-40B, and in accordance with further exemplary embodiments, the optical spacer 198 includes a central region 200 surrounded by an outer rim 202. The outer rim 202 has a substantially concave bottom section and first and second top sections. An outer flange 204 extends from the outer rim 202 on the bottom section and the first and second top sections. First and second spacer arms 206 extend from the first and second top sections, respectively. The first and second spacer arms 206 include a circular portion 208 and an angled planar portion 210. The central region 200 bounds a spacer channel 212. First and second projections 214 extend from the central region 200 into the spacer channel 212. In various exemplary embodiments, the optical spacer 198 is made from a polymer, for example acrylic. The optical spacer 198 can be translucent to allow light to pass through the spacer or it may be opaque.

Figure 41:
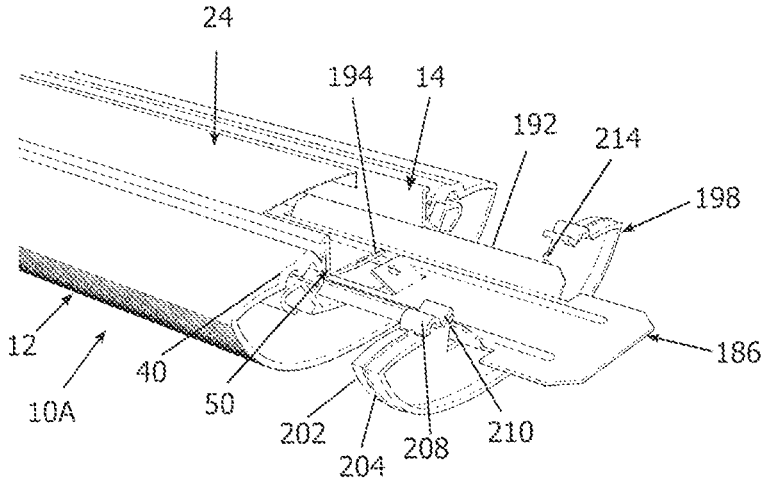
FIG. 41 is a perspective view of the connector plate and optical spacer of FIG. 34 partially inserted into a first luminaire.
Figure 42:
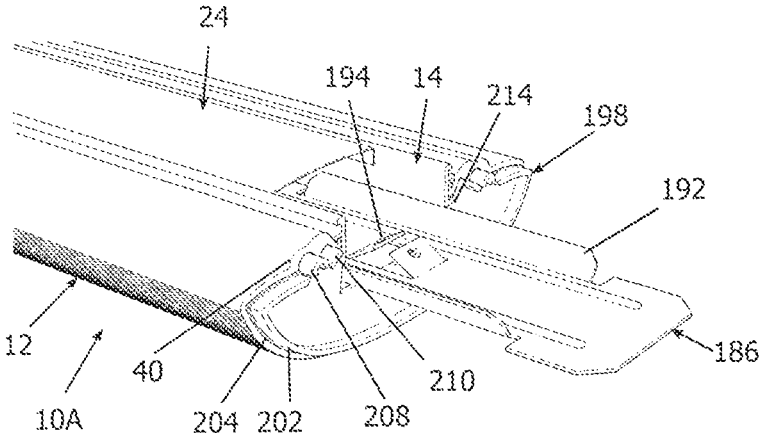
FIG. 42 is a perspective view of the connector plate and optical spacer of FIG. 34 fully inserted into a first luminaire.
Figure 43:
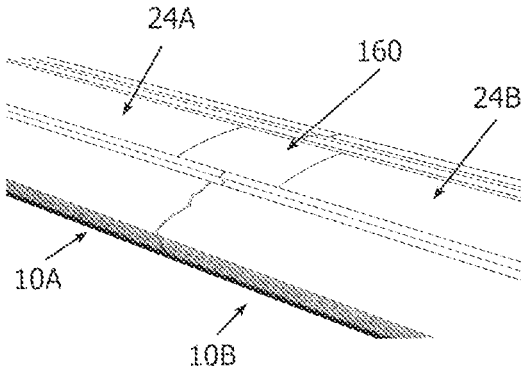
FIG. 43 is a perspective view of a first and second luminaire connected with the connector plate and optical spacer of FIG. 34.

As best shown in FIGS. 41-43, the connector plate 186 is slid into the light rail 14 center channel 82 of a first luminaire 10A so that the first and second side flanges 192 abut the light rail 14, for example the first and second arms 20, or the lip 70 formed between the first and second portions 60, 62 of the first and second arms 50. The optical spacer 198 is then slid onto the connector plate 186 with the connector plate 186 sliding through the spacer channel 212 and the first and second projections 214 abutting the first and second side flanges 192 and resting in the notch 196. The optical spacer 198 is positioned so that the outer rim 202 extends into the first luminaire 10A lens 12, with the circular portion 208 of the first spacer arm 206 extending into the cylindrical groove 40 of the lens 12. A set screw may then be inserted into the first tine 194 of the connector plate 186 and tightened to assist in securing the connector plate 186 to the light rail 14. A second luminaire 10B is then similarly connected to the other side of the connector plate 186. When two luminaires 10A, 10B are connected, the outer flange 204 extending from the outer rim 202 of the optical spacer 198 is positioned between the two. The extending cover 160 can be slidably connected to the assembly prior to connection of the second luminaire 10B, or the extending cover 160 can be press fit into place after both luminaires 10A, 10B are connected.

Figure 44:
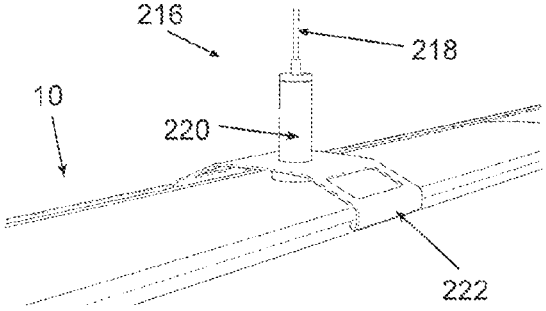
FIG. 44 is a perspective view of a suspension bracket connected to a luminaire according to an exemplary embodiment.
Figure 45:
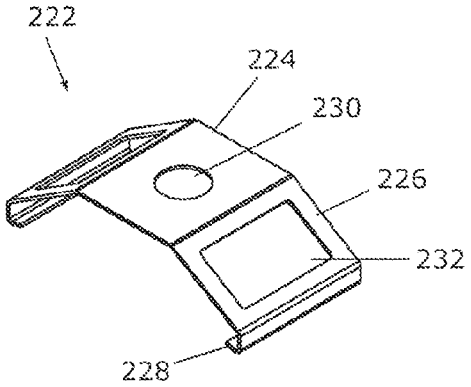
FIG. 45 is a perspective view of the suspension bracket of FIG. 44.
Figure 46:
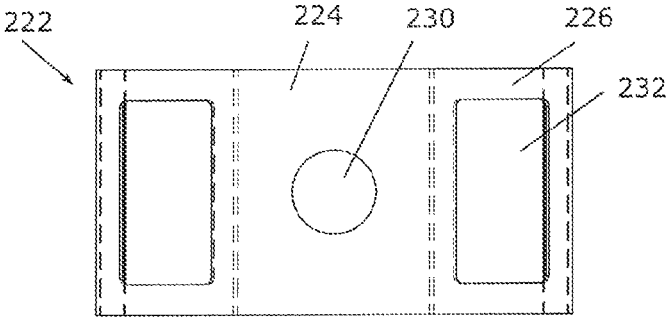
FIG. 46 is a top view of the suspension bracket of FIG. 45.
Figure 47:
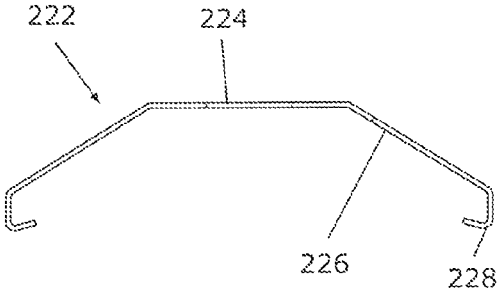
FIG. 47 is a front view of the suspension bracket of FIG. 45.

FIG. 44 shows a luminaire 10 connected to a suspension assembly 216 having a cable 218, a mounting adapter 220, and a suspension bracket 222. As best shown in FIGS. 46 and 47, and in accordance with further exemplary embodiments, the suspension bracket 222 includes a top section 224, first and second sides 226, and first and second hooks 228. The top section 224 includes a top aperture 230 for receiving the mounting adapter 220. The first and second sides 226 include side apertures 230 to reduce the weight and material of the suspension bracket and to increase the flexibility of the sides 226. The hooks 228 connect to a light rail 14, for example with the third protrusion 75 and/or the second side channel 80.

FIGS. 48-52 depict another exemplary a luminaire 310 that includes a support, for example a light rail 312 or other suitable support, and a lens 314 connected to the light rail 312. A flexible light emitting diode (LED) sheet is connected to the light rail 312 and positioned between the light rail 312 and the lens 314. A driver 318 is positioned on the light rail 312 and connected by one or more driver brackets 320. The driver 318 is electrically connected to the LED sheet. A top cover 324 is connected to the light rail 312 over the driver 318. First and second end brackets 326A, 326B are connected to the light rail 312 to enclose the sides of the driver 318. First and second end caps 328A, 328B are connected to the light rail 312 to enclose the sides of the light rail 12 and lens 14. In an exemplary embodiment, the components of the luminaire 10 can be configured as a two foot through four foot luminaire.

Figure 53:
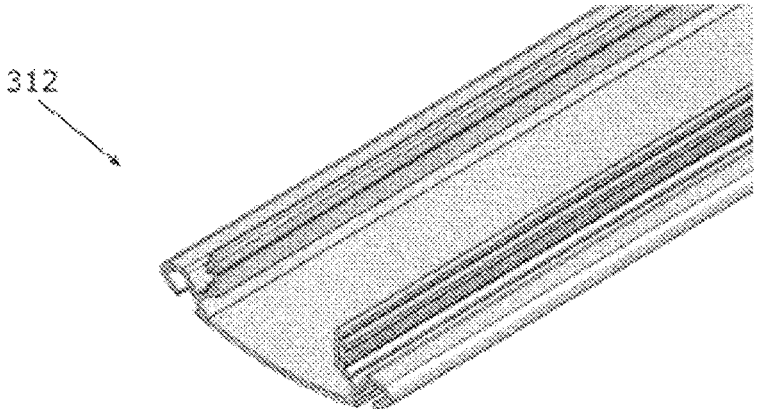
FIG. 53 is a partial perspective view of the light rail of FIG. 48.
Figure 54:
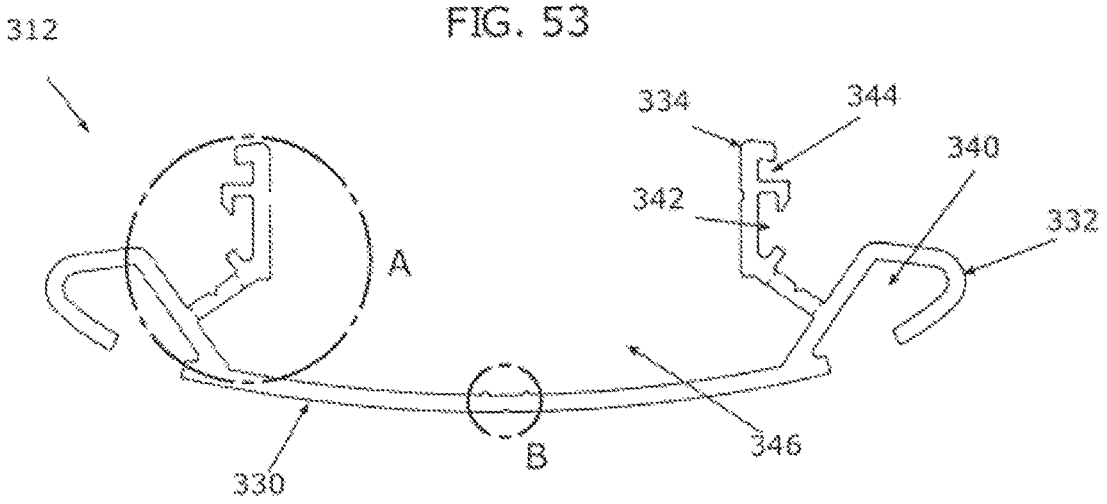
FIG. 54 is a front view of the light rail of FIG. 53.
Figure 54A:
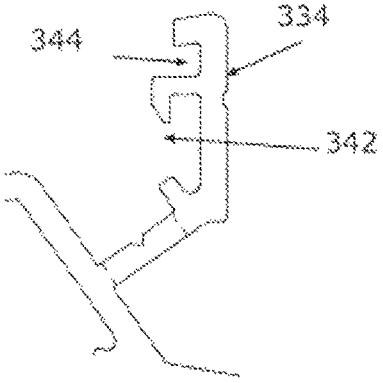
FIG. 54A is an enlarged view of area A of FIG. 54.
Figure 54B:
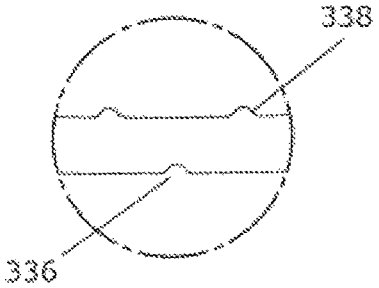
FIG. 54B is an enlarged view of area B of FIG. 54.

As best shown in FIGS. 53-54B, and in accordance with further exemplary embodiments, the light rail 312 includes a bottom portion 330, first and second side hooks 332, and first and second arms 334 extending form the side hooks 332. In various exemplary embodiments, the light rail 312 is made from metal, for example aluminum, and is extruded to any desired length. In alternative embodiments, other materials and methods of manufacture may be used. Various exemplary embodiments of the light rail 312 have the capability to flex or bow a certain amount depending on the luminaire configuration. As best shown in FIG. 54 the bottom portion 330 has a concave curve extending to a first end and a second end. The first and second hooks 332 extend from the bottom section 330 proximate the first and second ends. The first and second arms 334 extend from the first and second hooks 332. The bottom portion includes a notch 336 in the outer surface and a pair of protrusions 338 extending from the inner surface. The notch 336 acts as a drill point guide and the protrusions 338 assist in retaining a joiner rail 388 as discussed in further detail below.

According to an exemplary embodiment, the first and second hooks 332 have a substantially planar first section extending from the bottom portion 330 at an oblique angle away from the center of the light rail 312, a substantially planar second section extending from the first section at an oblique angle away from the center of the light rail 312, and a third section curving from the second section downwardly and back towards the center of the light rail 312. The first and second hooks 332 bound a first and second hook channel 340, respectively, with the free end of the first and second hooks 332 spaced from the bottom section 330 to define an opening.

The first and second arms 334 include a first portion and a second portion. In various exemplary embodiments, the first portion of the first and second arms 334 extends from the first section of the first and second hooks 332 at an oblique angle towards the center of the light rail 312. Each of the first portions include a first notch extending into an outer surface and first protrusions extending outwardly from the outer surface. In an exemplary embodiment, the first portions include one or more wireway openings (not shown). In various exemplary embodiments, the second portions extend outwardly from the respective first portions with a substantially vertical orientation. A first end of the second portion extends below the first portion to form a lip. Each of the second portions include a second notch formed into an inner surface, outwardly facing second protrusions having an angled prong extending from an outer surface, and outwardly extending third protrusions extending from the outer surface. The first and second protrusions bound a first side channel 342 and the second and third protrusions bound a second side channel 344. The light rail bottom 330, first and second hooks 332, and first and second arms 334 bound a center channel 346.

Figure 55:
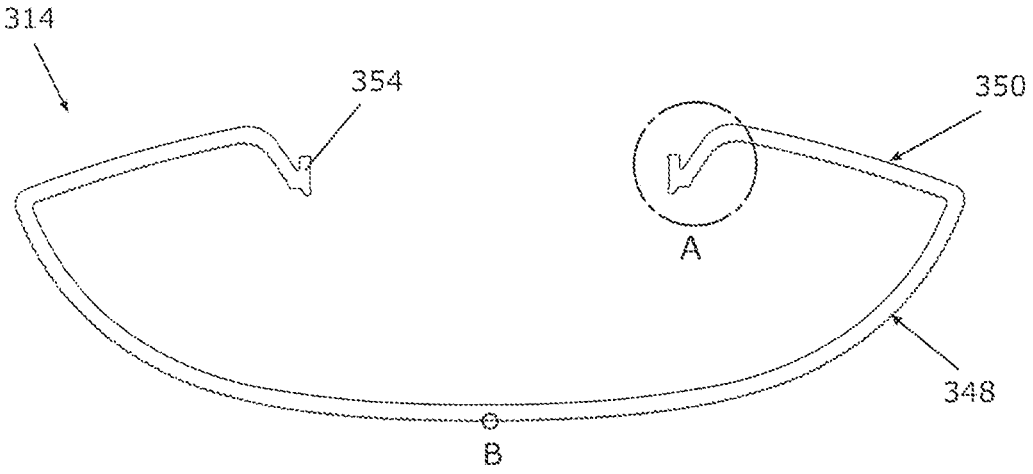
FIG. 55 is a front view of the lens of FIG. 48.
Figure 55A:
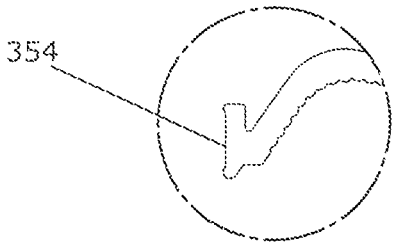
FIG. 55A is an enlarged view of area A of FIG. 55.
Figure 55B:
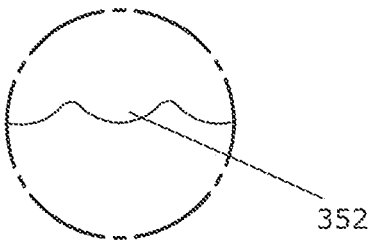
FIG. 55B is an enlarged view of area B of FIG. 55.

As best shown in FIGS. 55-55B, and in accordance with further exemplary embodiments, the lens 314 includes a bottom section 348, and first and second top sections 350. In various exemplary embodiments, the lens 314 is made from a polymer material, for example acrylic, and is extruded to any desired length. In alternative embodiments, other materials and methods of manufacture may be used. The bottom section 348 has a concave curve extending to a first and second corner. The bottom section 348 includes an outer surface having a plurality of prisms 352. According to an exemplary embodiment, the prisms 352 are rounded prisms as shown, for example, in FIG. 55. The size, shape, spacing, and configuration of the prisms 352 can vary depending on the desired light output.

The first and second top sections 350 extend from the bottom section 348 toward the center of the lens 314. The first and second top sections 348 each have an inner surface and a set of prisms 352 extending from the inner surface. First and second flanges 354 extend from the first and second top sections 348, respectively. When assembled, the first and second flanges 354 engage with the first side channel 342 of the rail 312.

Figure 48:
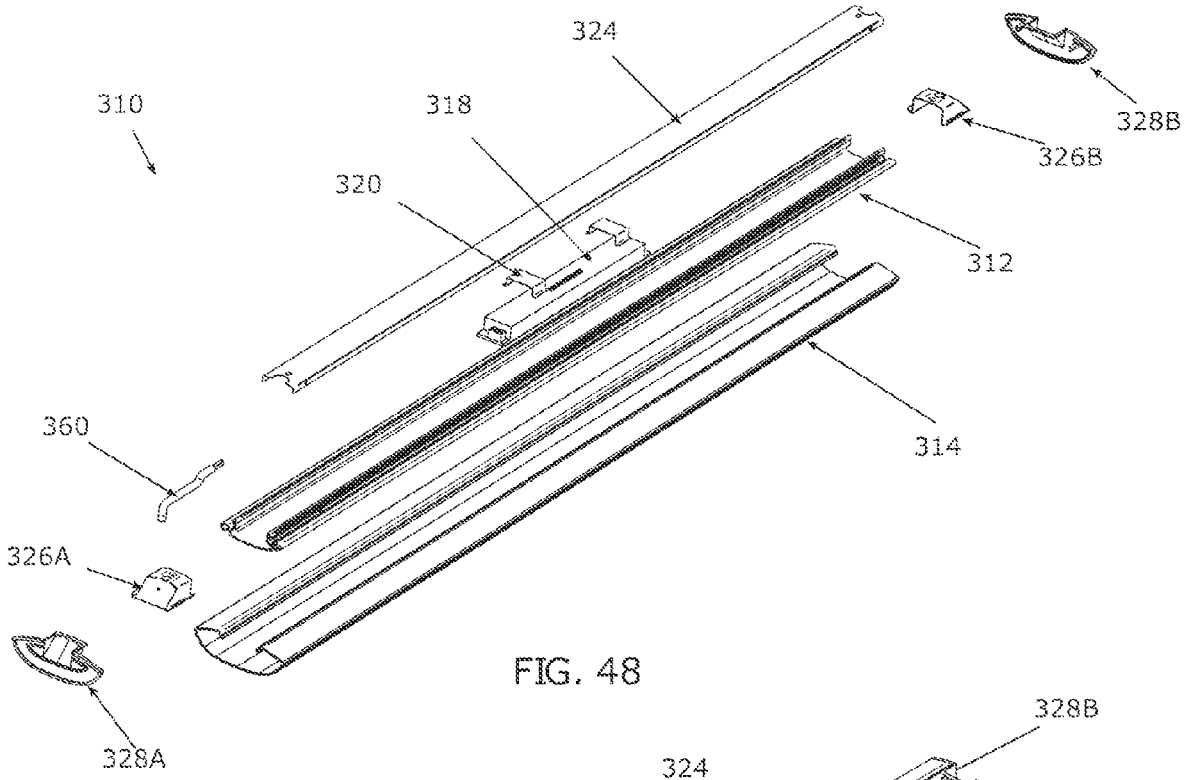
FIG. 48 is an exploded, perspective view of another exemplary luminaire.
Figure 49:
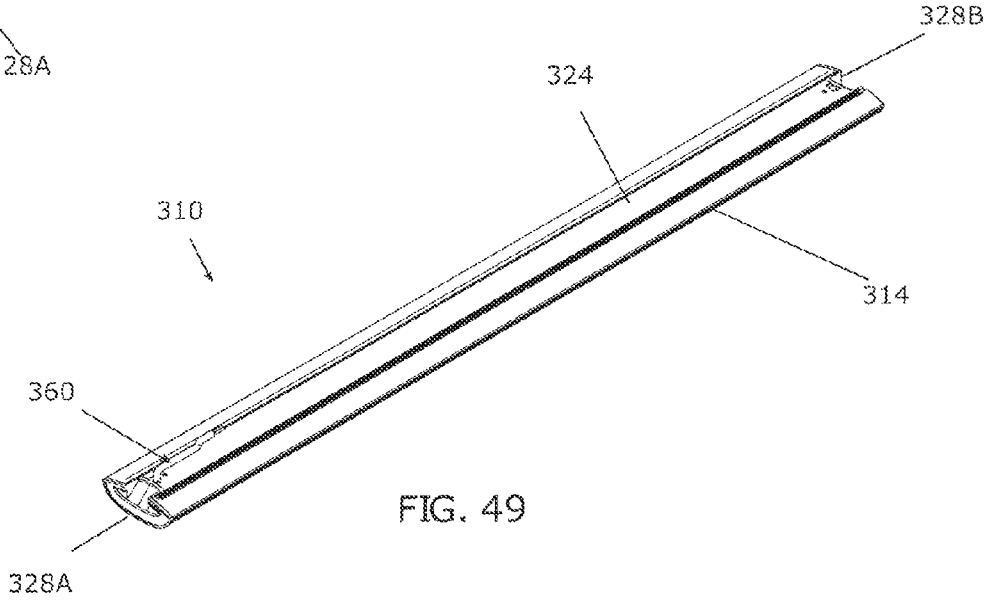
FIG. 49 is a perspective view of the luminaire of FIG. 48.
Figure 50:
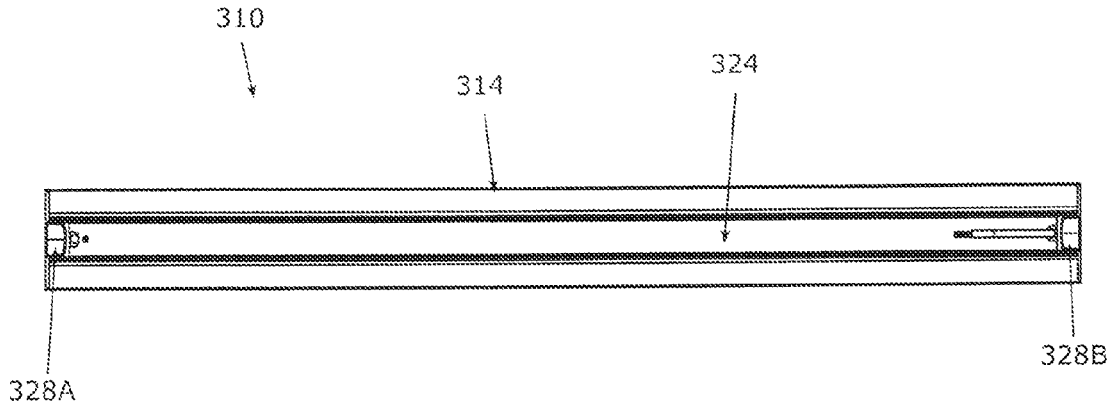
FIG. 50 is a top view of the luminaire of FIG. 48.
Figure 51:
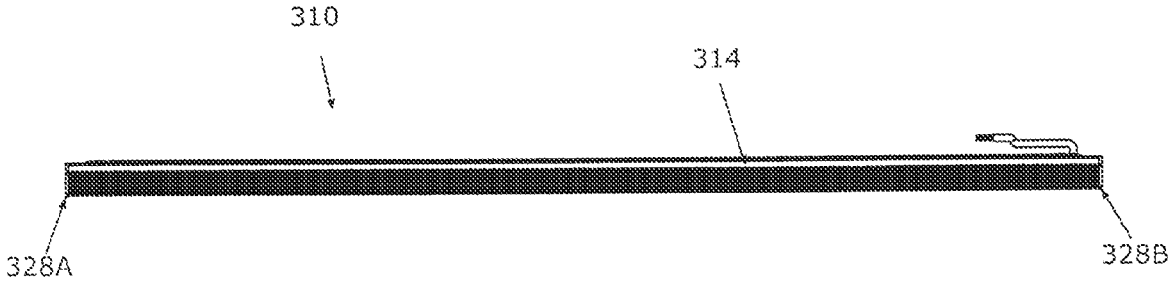
FIG. 51 is a left side view of the luminaire of FIG. 48.
Figure 52:
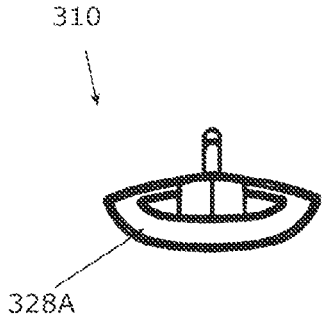
FIG. 52 is a front view of the luminaire of FIG. 48.

As best shown in FIG. 48, and in accordance with further exemplary embodiments, the driver 318 is connected to the light rail 312 through one or more driver brackets 320. The driver bracket 320 has a substantially U-shaped body with a top section, first and second side sections, and first and second flanges extending from the first and second side sections, respectively. In various exemplary embodiments, the driver bracket 320 is made from metal, for example stainless steel, although in alternative embodiments, other materials may be used.

Although not shown, the driver 318 may be positioned in the light rail 312 center channel 346 and one or more driver brackets 320 are positioned over the driver 318 and connected to the light rail 312, for example through engagement of the driver bracket 320 flange and the lip formed between the first and second portions of the first and second arms 334. The driver bracket 320 may be slidable connected or snap fit to the light rail 312.

Figure 56:
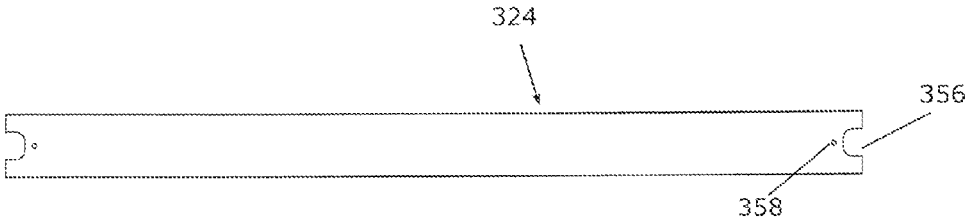
FIG. 56 is a top view of the cover of FIG. 48.
Figure 57:
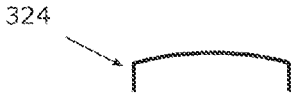
FIG. 57 is a front view of the cover of FIG. 56.
Figure 58:
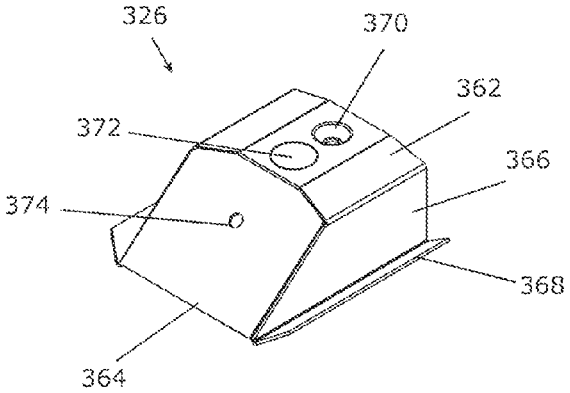
FIG. 58 is a perspective view of the end bracket of FIG. 48.
Figure 59:
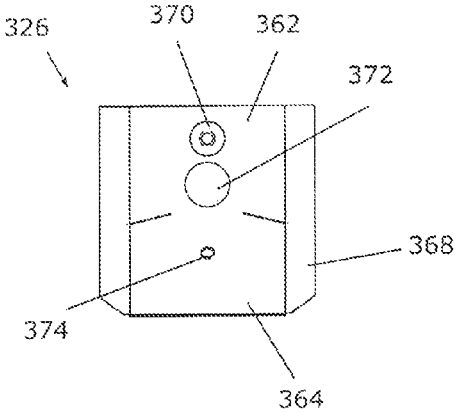
FIG. 59 is a top view of the end bracket of FIG. 58
Figure 60:
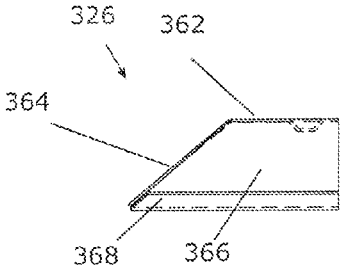
FIG. 60 is a right side view of the end bracket of FIG. 58.
Figure 61:
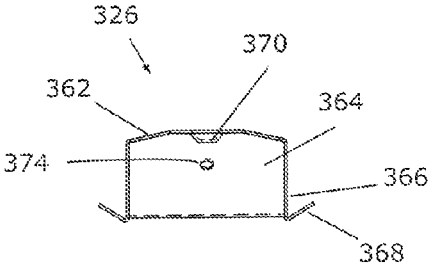
FIG. 61 is a rear view of the end bracket of FIG. 61.

As best shown in FIGS. 56 and 57, and in accordance with further exemplary embodiments, the cover 324 is substantially U-shaped with a curved top surface and first and second sides extending downwardly from the top surface. The cover 324 has a first end and a second with a substantially U-shaped slot 356 positioned at each end. An aperture 358 is positioned near each slot 356. The slot 356 accommodates for the passage of one or more conductors, for example a cable 360 that connects the driver to a power source such as a hard-wired connection. The aperture 358 allows for passage of a fastener to connect the cover 324 to the end bracket 326. In various exemplary embodiments, the cover 324 is made from metal, for example aluminum, and is extruded to any desired length. In alternative embodiments, other materials and methods of manufacture may be used.

FIGS. 58-61 shows a first exemplary embodiment of an end bracket 326 having a top section 362, an angled front wall 364, first and second side walls 366, and first and second flanges 368 extending from the first and second side walls 366, respectively. The top section 362 includes a center portion and angled side portions. The center portion includes a first aperture 370 and a second aperture 372. The first aperture 370 of the end bracket 326 aligns with the aperture 358 of the cover 324 to receive a fastener, connecting the cover 324 to the end bracket 326. The second aperture 372 of the end bracket 326 aligns with the substantially U-shaped slot 356 of the cover 324. The cable 360 extends through the slot 356 and the second aperture 372 to connect to the driver 320. The edges of the cover 324 surrounding the slot 356 extend over at least a portion of the end bracket 326, for example the angled side portions. The front wall 364 includes a stud 374 for a grounding connection. In an exemplary embodiment, a grounding wire and eyelet (not shown) are fastened with a hex nut and connected to the stud 375. This connection provides grounding for the driver 318. The end bracket 326 is connected to the light rail 312 with the first and second flanges 368 retaining the end bracket 326 in the center channel 346 of the light rail 312. In various exemplary embodiments, the end bracket 326 can be slidably connected and/or snap connected to the light rail 312.

The end cap 328 is connected to the light rail 312 over the end bracket 326. In an exemplary embodiment, the end cap includes a bottom flange, and first and second mounting posts extending from a rear surface as shown in FIGS. 18-22. The end cap 328 is inserted into the light rail 312 so that the bottom flange engages the inner surface of the of the bottom section of the lens 314 and the first and second mounting posts extend into the first and second hook channels, respectively. The end cap 328 can include an angled wall that aligns with the angled front wall of the end bracket 326

Figure 62:
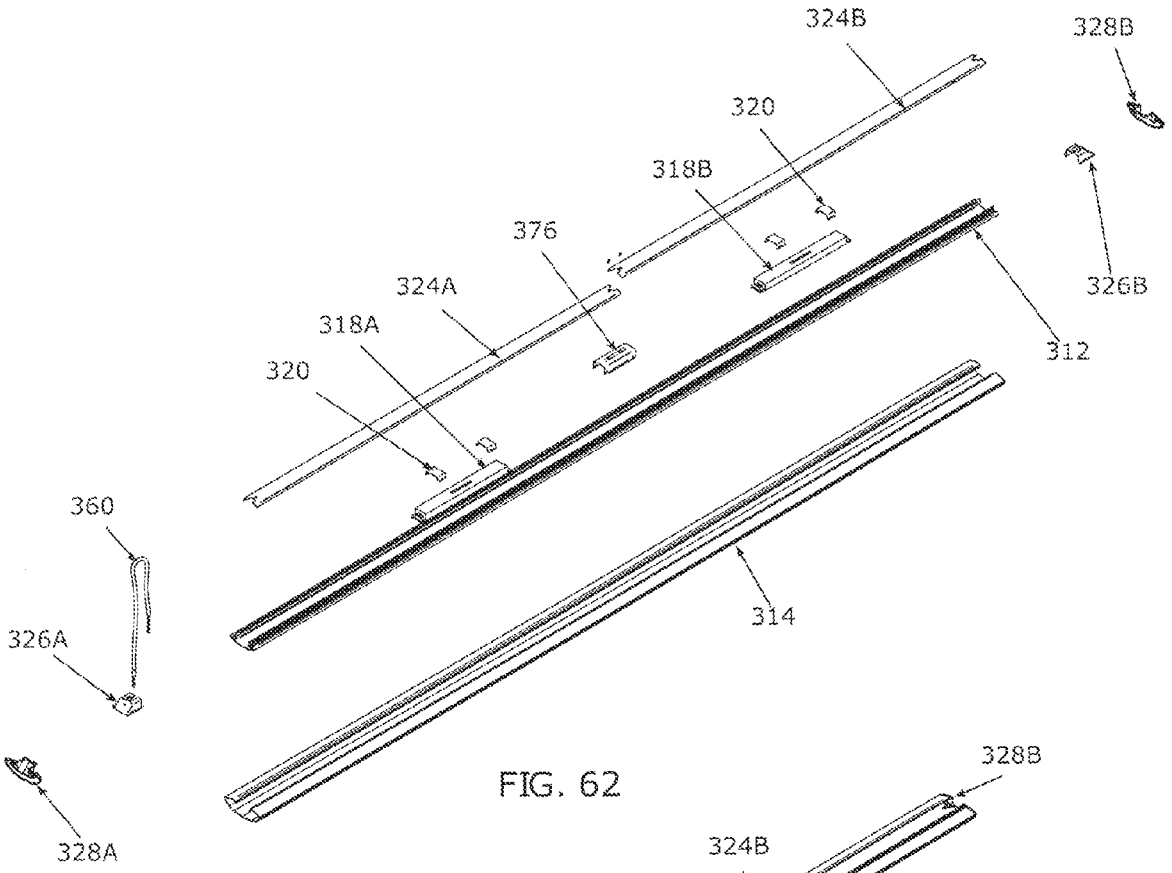
FIG. 62 is an exploded, perspective view of another exemplary luminaire.
Figure 63:
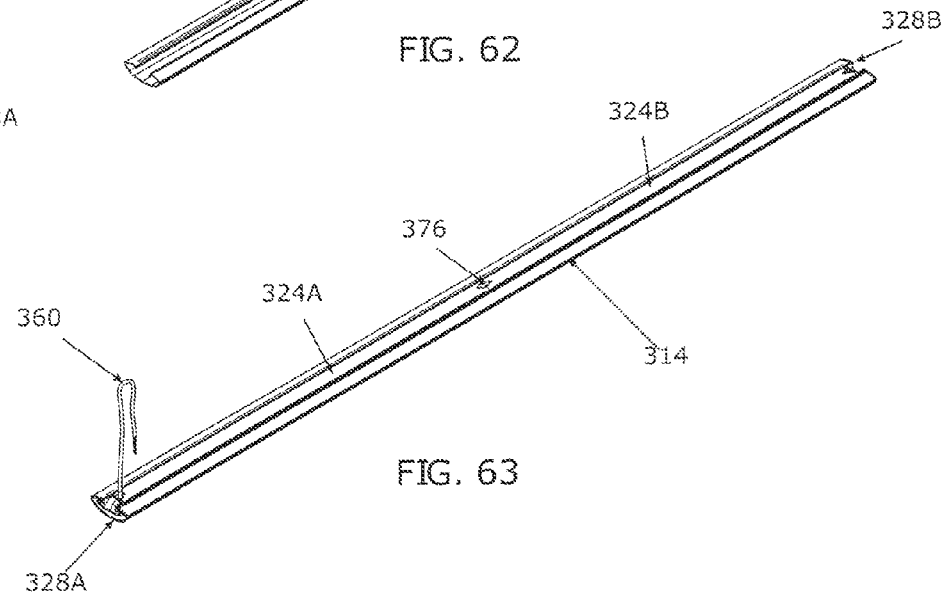
FIG. 63 is a perspective view of the luminaire of FIG. 62.

In accordance with various exemplary embodiments, the luminaire 310 is modular and capable of connecting with other modules. FIGS. 62 and 63 show another exemplary luminaire, configured as a longer luminaire, for example a six through eight foot luminaire. The luminaire includes a light rail 312 and a lens 314 connected to the light rail 312. The light rail 312 and lens 314 can be the same or similar to those of the luminaire 310 shown in FIG. 48, but formed longer. A flexible LED sheet is connected to the light rail 312 and positioned between the light rail 312 and the lens 314. A single LED sheet or multiple LED sheets may be used. A first driver 318A and a second driver 318B are positioned on the light rail 312 and connected by one or more driver brackets 320. The drivers 318A, 318B are electrically connected to the one or more LED sheets. A first top cover 324A and a second top cover 324B are connected to the light rail 312 over the drivers 318A, 318B. A center bracket 376 is positioned in the light rail 312 to connect the first and second top covers 324A, 324B. First and second end brackets 326A, 326B are connected to the light rail 312 to enclose the sides of the drivers 318A, 318B. First and second end caps 328A, 328B are connected to the light rail 312 to enclose the sides of the light rail 312 and lens 314.

Figure 64:
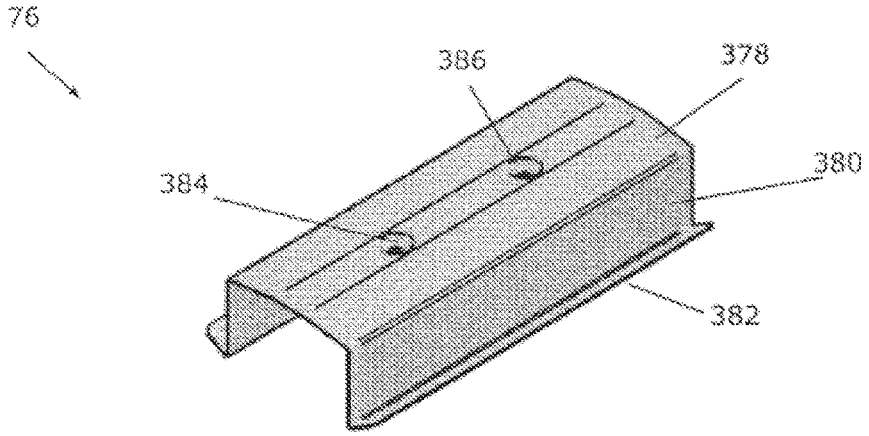
FIG. 64 is a perspective view of the center bracket of FIG. 62.
Figure 65:
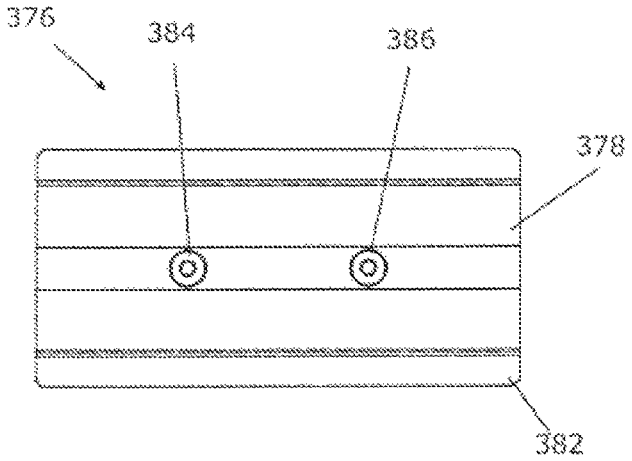
FIG. 65 is a top view of the center bracket of FIG. 64.
Figure 66:
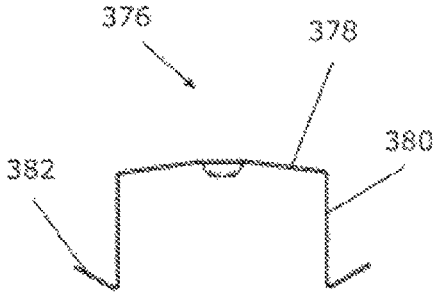
FIG. 66 is a front view of the center bracket of FIG. 64.

FIGS. 64-66 show a center bracket 376 according to an exemplary embodiment. The center bracket 376 includes a top section 378, first and second side walls 380, and first and second flanges 382 extending from the first and second side walls 380, respectively. The top section 378 includes a first aperture 384 and a second aperture 386. The first aperture 384 of the center bracket 376 aligns with the aperture 358 of the first cover 324A to receive a fastener, connecting the first cover 324A to the center bracket 376. The second aperture 386 of the center bracket 376 aligns with the aperture 358 of the second cover 324B to receive a fastener, connecting the second cover 324B to the center bracket 376. In various exemplary embodiments, the center bracket 376 can be slidably connected and/or snap connected to the light rail 312, for example the center channel 346, with the first and second flanges 382 assisting to secure the center bracket 376 to the light rail 312.

FIGS. 67-73 show an exemplary embodiment of an extension assembly that can connect multiple luminaires or connect a similar extension to a luminaire, for example first and second luminaires 310A, 310B. The extensions assembly includes a joiner rail 388, a joiner bracket 390, and an optical spacer 392. The joiner rail 388 connects to the light rails 312A, 312B of the first and second luminaires 310A, 310B. The joiner bracket 390 connects to the joiner rail 388 and first and second top covers 324A, 324B. The optical spacer 392 connects to the joiner rail 388 and the first and second lens 314A, 314B.

Figure 67:
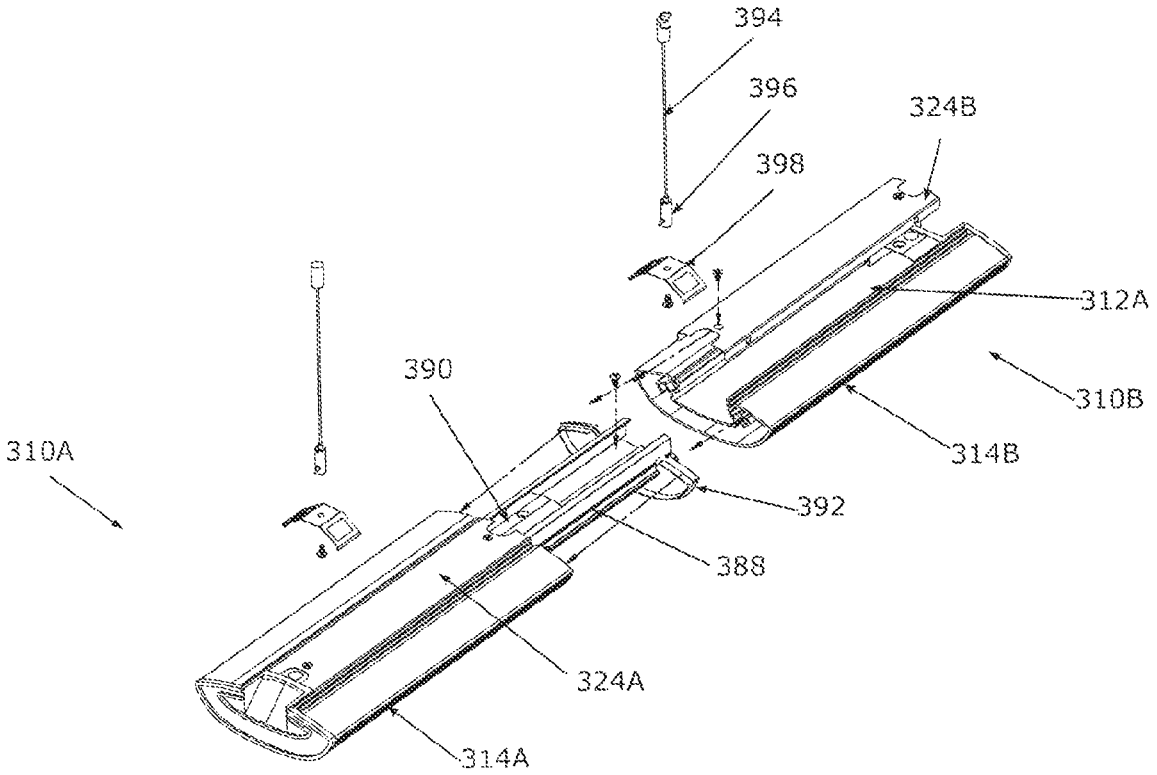
FIG. 67 is a partially exploded, perspective view of another exemplary luminaire.
Figure 68:
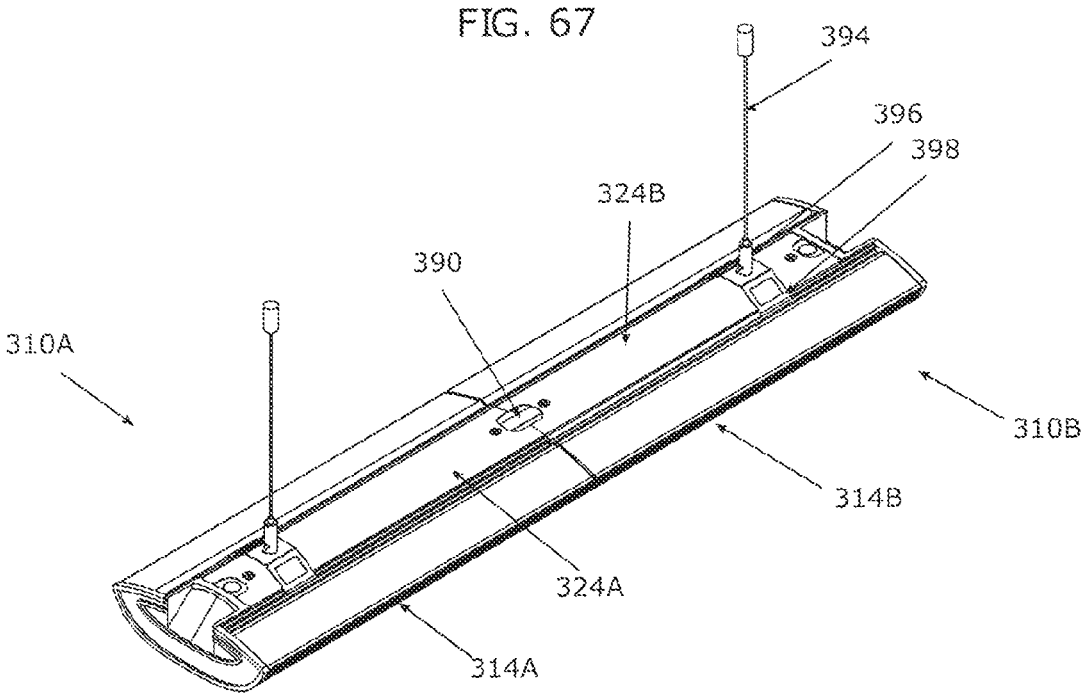
FIG. 68 is a perspective view of the luminaire of FIG. 67.
Figure 69:
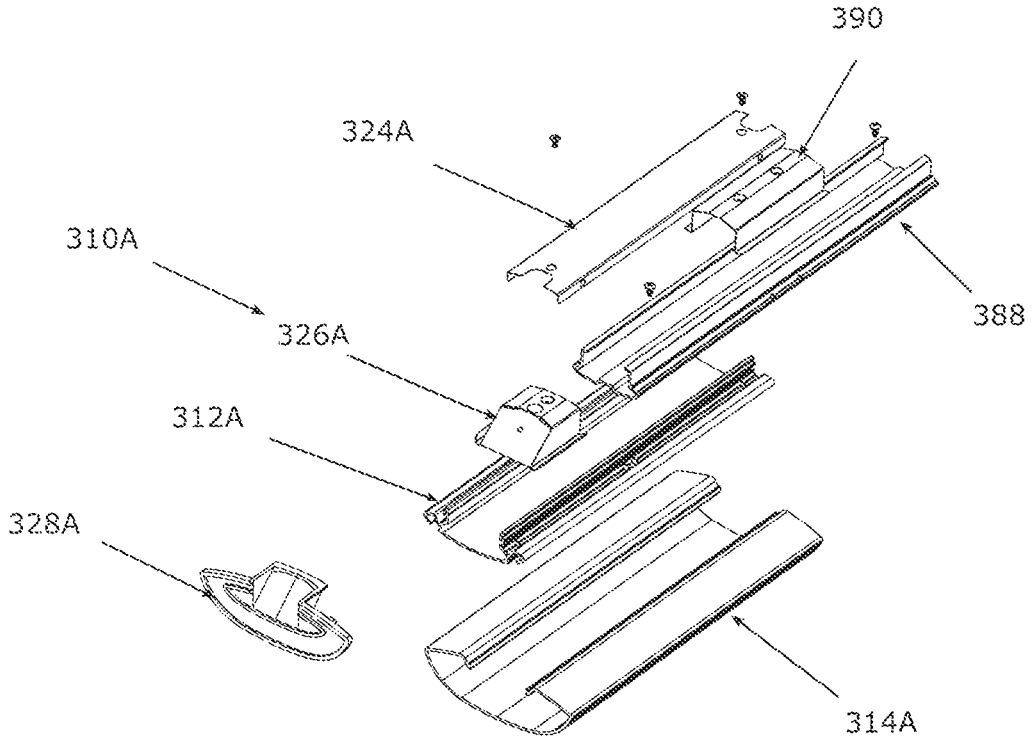
FIG. 69 is an exploded, perspective view of the first portion of the luminaire of FIG. 67.
Figure 70:
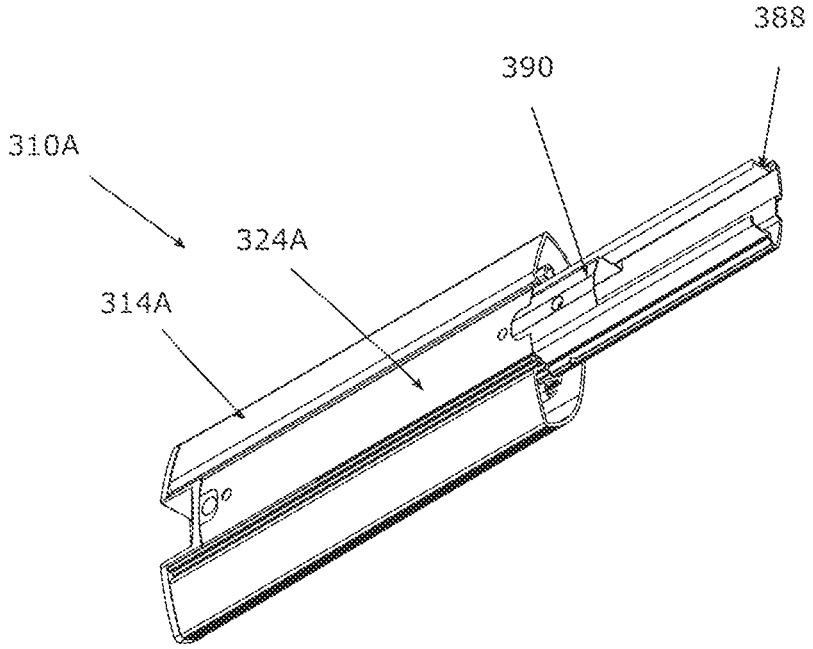
FIG. 70 is a perspective view of the first portion of the luminaire of FIG. 67.
Figure 71:
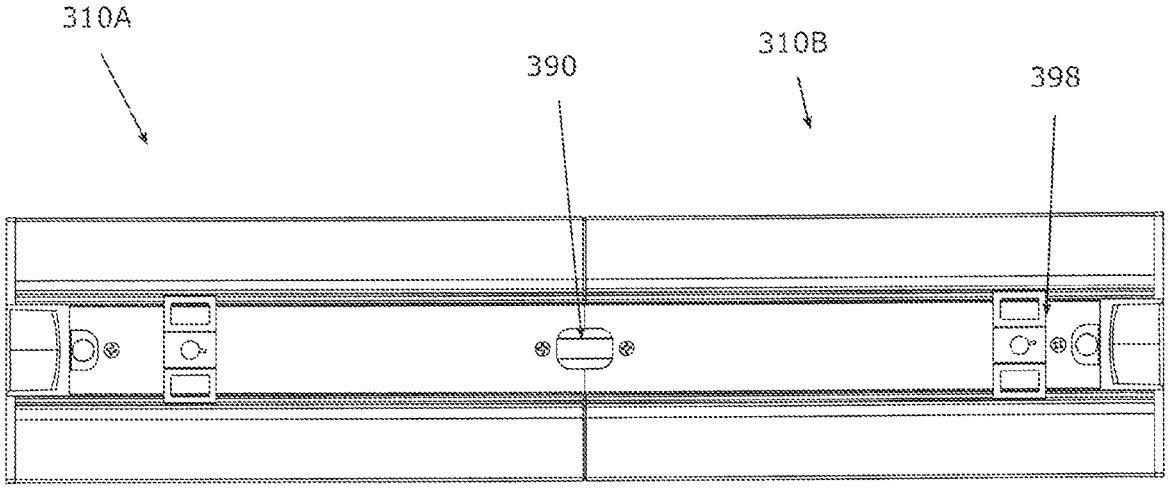
FIG. 71 is a top view of the luminaire of FIG. 67.
Figure 72:
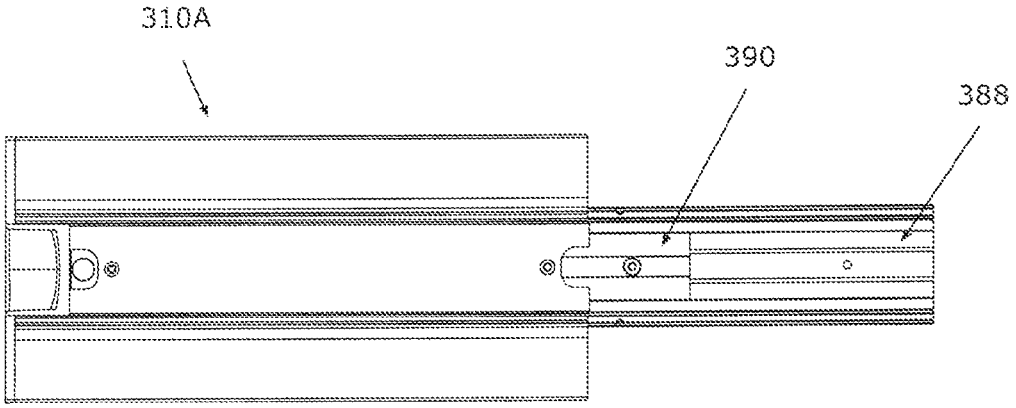
FIG. 72 is a top view of the first portion of the luminaire of FIG. 67.
Figure 73:
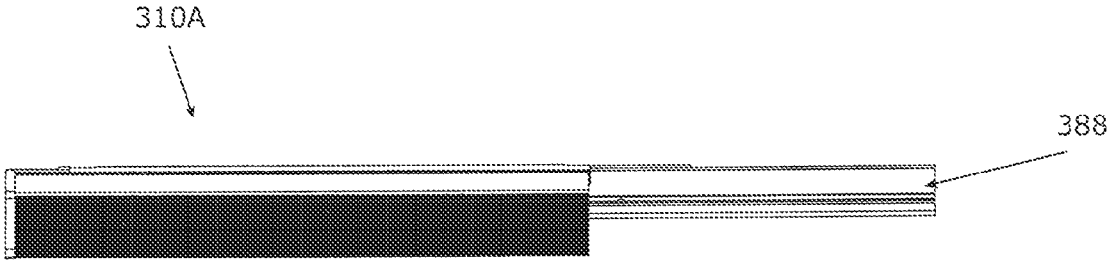
FIG. 73 is a right side view of the first portion of the luminaire of FIG. 67.

FIGS. 67 and 68 also show the luminaire connected to a suspension assembly having a cable 394, a mounting adapter 396, and a suspension bracket 398. In an exemplary embodiment, the suspension bracket 398 includes a top section, first and second sides, and first and second hooks. The top section includes a top aperture for receiving the mounting adapter 396. The first and second sides include side apertures to reduce the weight and material of the suspension bracket and to increase the flexibility of the sides. The hooks connect to the light rail 312, for example with the third protrusion and/or the second side channel 344.

Figure 74:
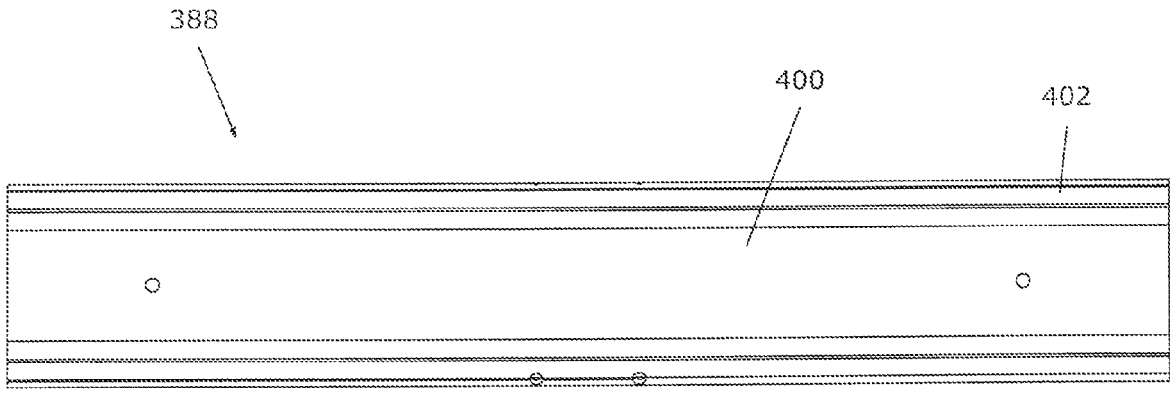
FIG. 74 is a top view of the joiner rail of FIG. 67.
Figure 75:
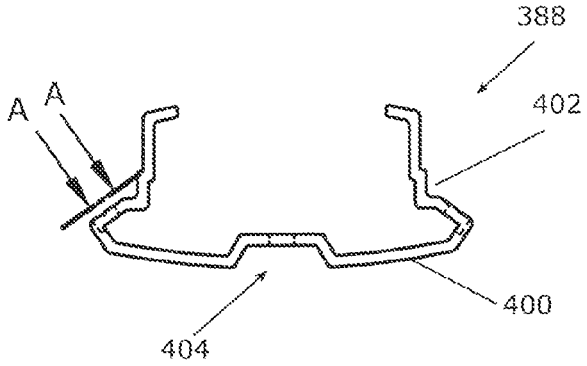
FIG. 75 is a front view of the joiner rail of FIG. 64.
Figure 75A:
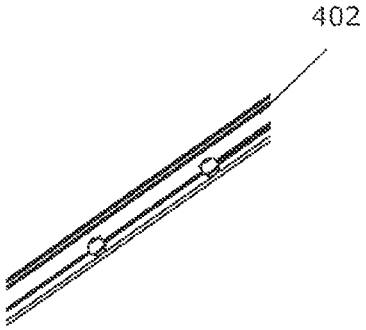
FIG. 75A is a partial, sectional view of FIG. 75 taken along line A-A and viewed in direction of the arrows.

FIGS. 74-75A show an exemplary embodiment of the joiner rail 388. The joiner rail 388 includes a bottom portion 400 and first and second arms 402 extending from the bottom portion 400. The bottom portion 400 includes a channel 404 bound by angled side walls and a top wall. The side walls engage the protrusions 338 that extend from the bottom 330 of the light rail 312, to help keep the joiner rail 388 in place. The bottom portion 400 includes a first pair of apertures to receive set screws to secure the joiner rail 388 to the light rail 312. The bottom portion 400 and the first and second arms 402 meet at a shoulder. When the joiner rail 388 is connected to the light rail 312, the shoulders slide into the center channel 346. The first and second arms 402 each include a second pair of apertures, as best shown in FIG. 75A, that are used to align the joiner rail 388 in the proper position with the light rail 312.

Figure 76:
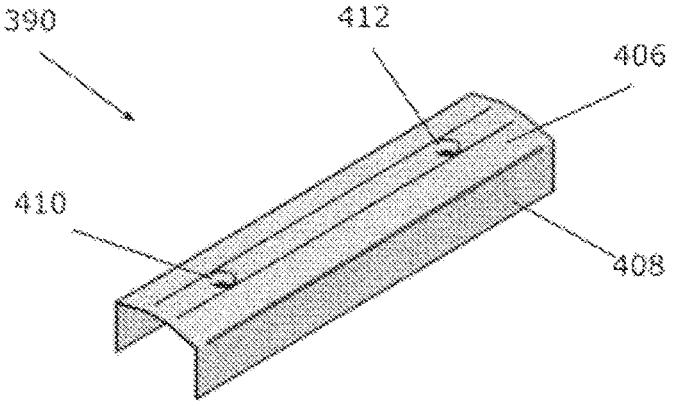
FIG. 76 is a perspective view of the joiner bracket of FIG. 67.
Figure 77:
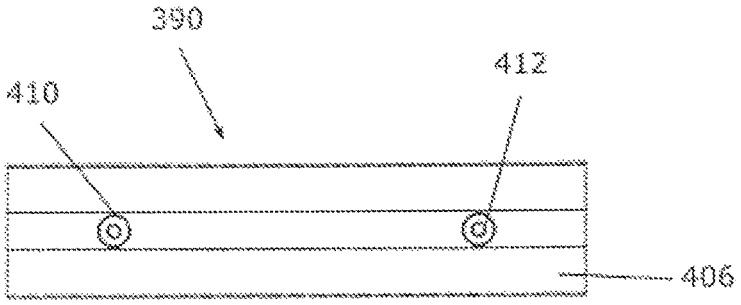
FIG. 77 is a top view of the joiner bracket of FIG. 76.
Figure 78:
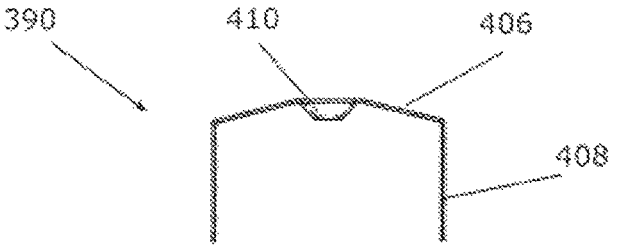
FIG. 78 is front view of the joiner bracket of FIG. 76.
Figure 79:
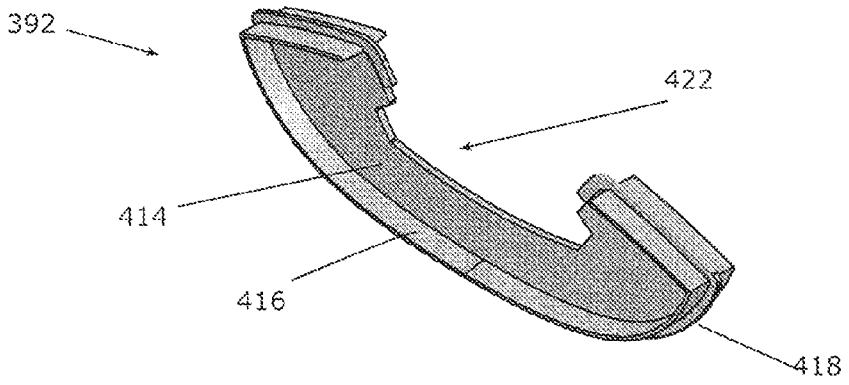
FIG. 79 is a perspective view of the optical spacer of FIG. 67.
Figure 80:
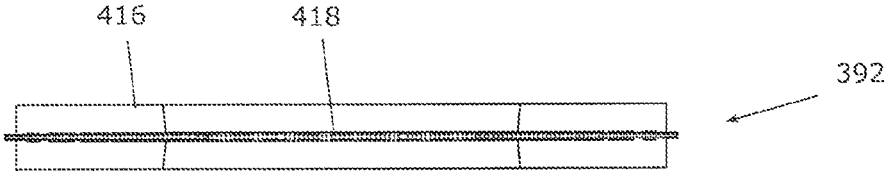
FIG. 80 is a top view of the optical spacer of FIG. 79.
Figure 81:
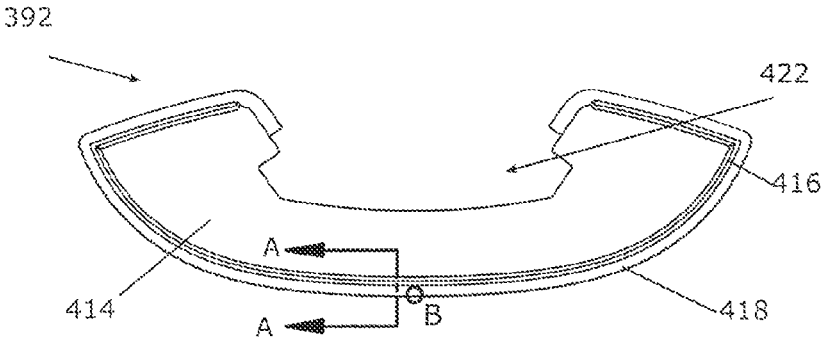
FIG. 81 is a front view of the optical spacer of FIG. 79.
Figure 82:
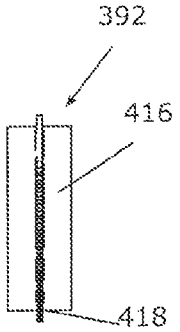
FIG. 82 is a right side view of the optical spacer of FIG. 79.
Figure 81A:
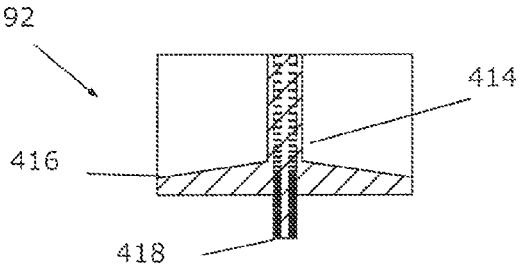
FIG. 81A is a sectional view of FIG. 81 taken along line A-A and viewed in direction of the arrows.
Figure 81B:
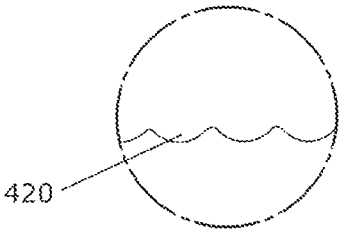
FIG. 81B is an enlarged view of area B in FIG. 81.

FIGS. 76-78 show an exemplary embodiment of the joiner bracket 390. The joiner bracket 390 includes a top section 406 and first and second side walls 408. The top section 406 includes a first aperture 410 and a second aperture 412. The first aperture 410 of the joiner bracket 390 aligns with the aperture 358 of the first cover 324A to receive a fastener, connecting the first cover 324A to the joiner bracket 390. The second aperture 412 of the joiner bracket 390 aligns with the aperture 358 of the second cover 324B to receive a fastener, connecting the second cover 324B to the joiner bracket 390. In various exemplary embodiments, the joiner bracket 390 is slidably connected to the light rails 312A, 312B. In an alternative embodiment, the joiner bracket 390 can include first and second flanges assisting to secure the joiner bracket to the light rails 312A, 312B, similar to the center bracket 376.

FIGS. 79-81B show an exemplary embodiment of the optical spacer 392. The optical spacer 392 includes a central region 414 surrounded by an outer rim 416. The outer rim 416 has a substantially concave bottom section and first and second top sections. An outer flange 418 extends from the outer rim 416 on the bottom section and the first and second top sections. The outer flange 118 includes a plurality of prisms 420. According to an exemplary embodiment, the prisms 420 are rounded prisms as shown, for example, in FIG. 81B. The size, shape, spacing, and configuration of the prisms 420 can vary depending on the desired light output. In an exemplary embodiment, the prisms 420 of the optical spacer 392 match the prisms 352 of the lens 314. The central region 414 bounds a channel 422 that slidable connects with the joiner rail 388. In various exemplary embodiments, the optical spacer 392 is made from a polymer, for example acrylic. The optical spacer 392 can be translucent to allow light to pass through the spacer or it may be opaque.

The joiner rail 388 is slid into the light rail 312A center channel 346 of a first luminaire 310A so that the first and second shoulders of the joiner rail 388 abut the light rail 312A. The cover 324A of the first luminaire 310A is connected to the joiner bracket 390 with a fastener. A set screw may then be inserted into the joiner rail 388 and tightened to assist in securing the joiner rail 388 to the light rail 312A. The optical spacer 392 can also be slid onto the joiner rail 388. The optical spacer 392 is positioned so that the outer rim 416 extends into the first luminaire 310A lens 314A. A second luminaire 310B is then similarly connected to the other side of the joiner rail 388. When two luminaires 310A, 310B are connected, the outer flange 418 extending from the outer rim 416 of the optical spacer 392 is positioned between the two lenses 314A, 314B.

Figure 83:
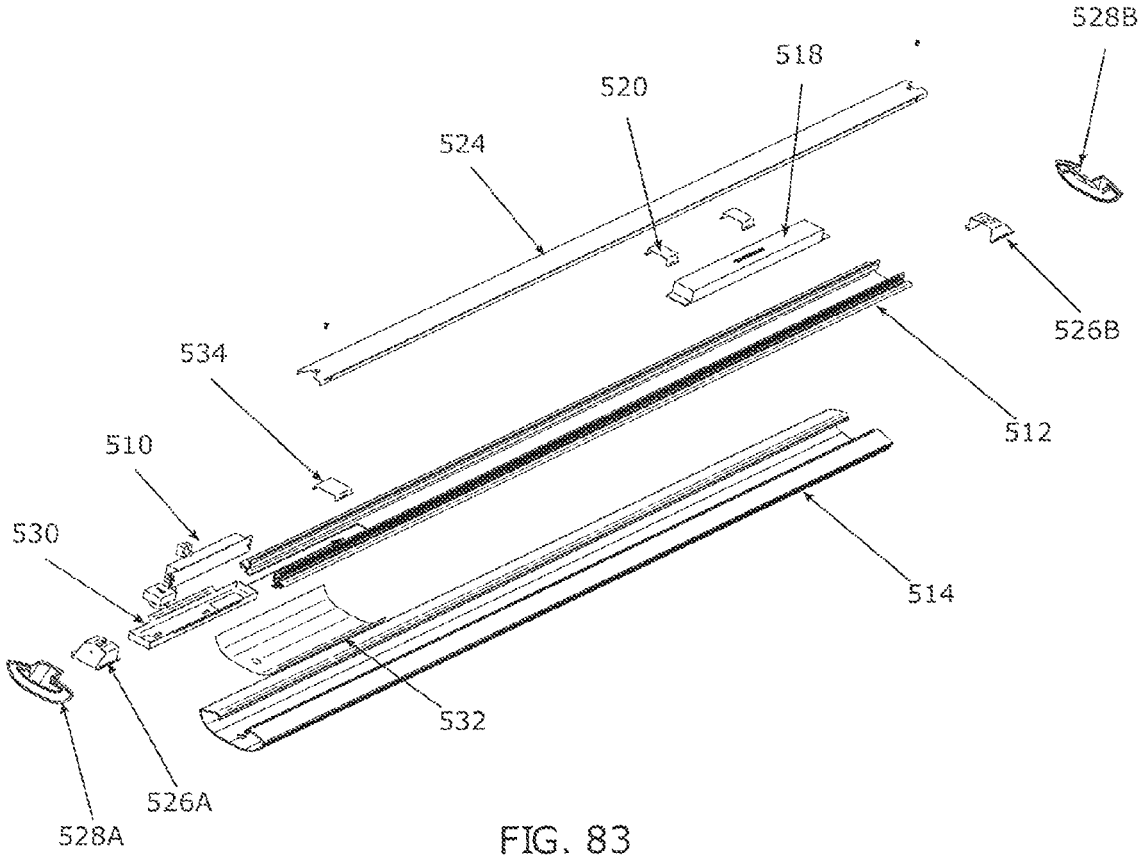
FIG. 83 is an exploded, perspective view of another exemplary luminaire.
Figure 84:
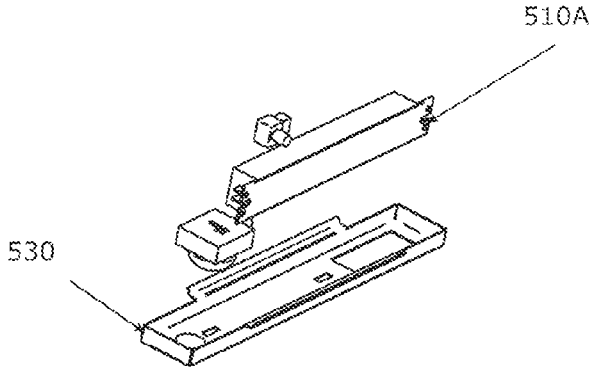
FIG. 84 is an exploded, perspective view of the tray of FIG. 83 and an exemplary sensor unit.
Figure 85:
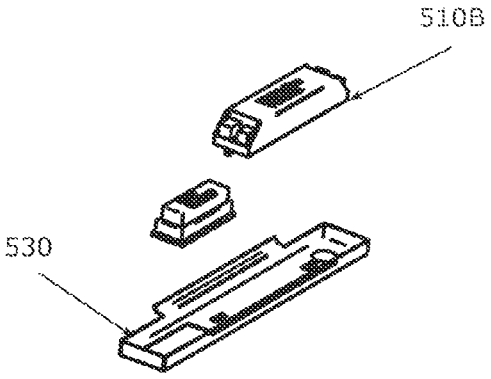
FIG. 85 is an exploded, perspective view of the tray of FIG. 83 and another exemplary sensor unit.

FIG. 83 shows another exemplary embodiment of a luminaire used in connection with a control component, for example a sensor module 510, such as an occupancy sensor. The control component can include any device that is used to control or monitor the luminaire 500. Similar to the embodiments discussed above, the luminaire includes a light rail 512, a lens 514, an LED sheet (not shown), a driver 518 connected by one or more driver brackets 520, a top cover 524, first and second end brackets 526A, 526B, and first and second end caps 528A, 528B. The luminaire also includes a tray 530 and a shield 532. The tray 530 retains the sensor module 510 components and slidably connects to the light rail 512. A bracket 534 helps secure the sensor module 510 to the tray 530 and the light rail 512. The shield 532 is positioned between the light rail 512 and the lens 514 to cover the tray 530 and sensor components from view. FIG. 84 depicts a first exemplary type of sensor 510A having a round sensor. FIG. 85 depicts a second exemplary type of occupancy sensor 510B having a rectangular sensor. The configuration and components of such sensors are commercially available and would be understood by one of ordinary skill in the art. Different types of sensors, including occupancy, motion, and light sensors, can be used.

Figure 86:
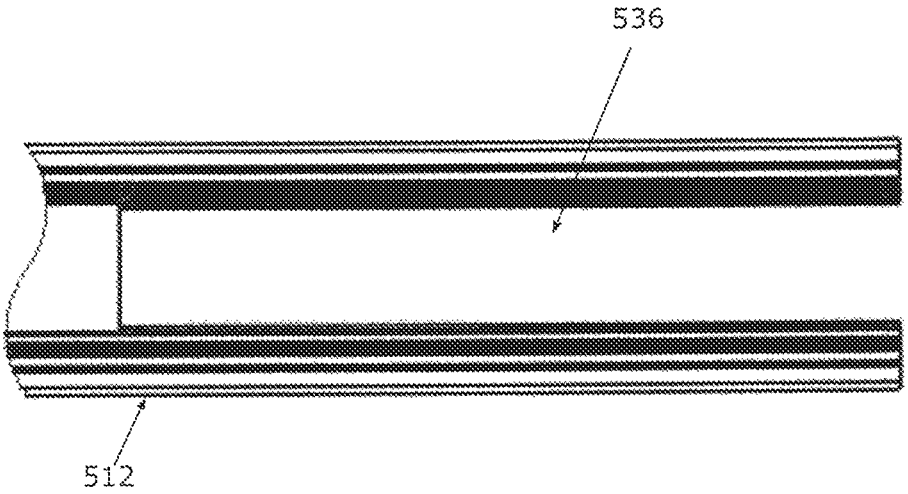
FIG. 86 is a partial top view of the rail of FIG. 83.
Figure 87:
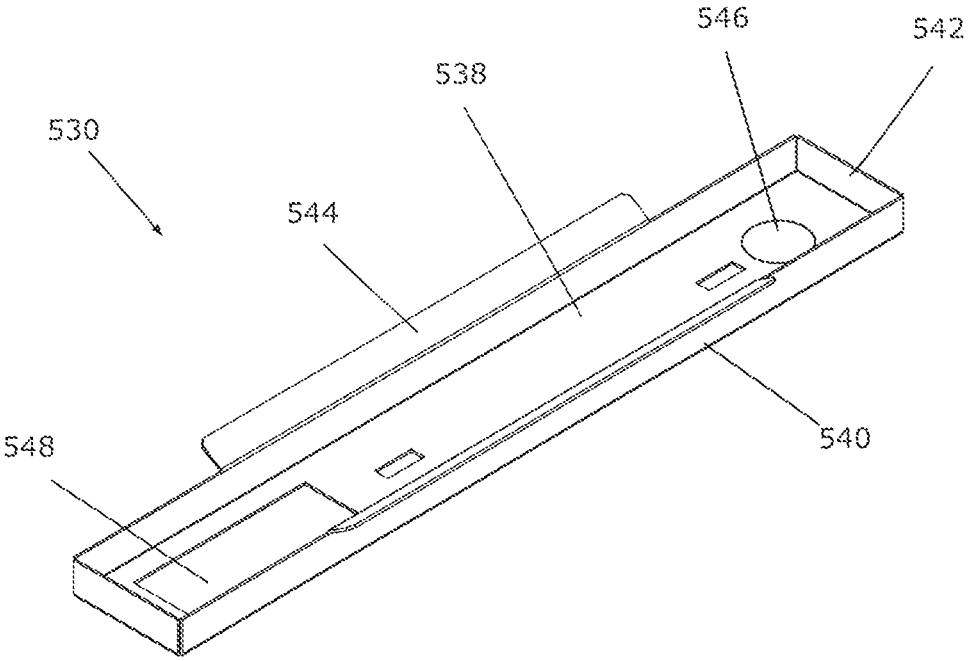
FIG. 87 is a perspective view of the tray of FIG. 83.
Figure 88:
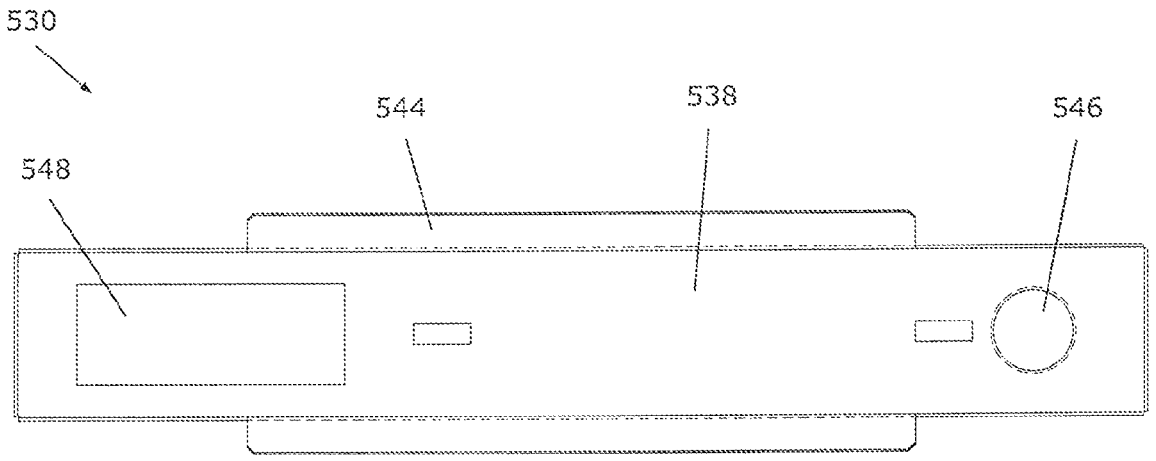
FIG. 88 is a top view of the tray of FIG. 87.
Figure 89:
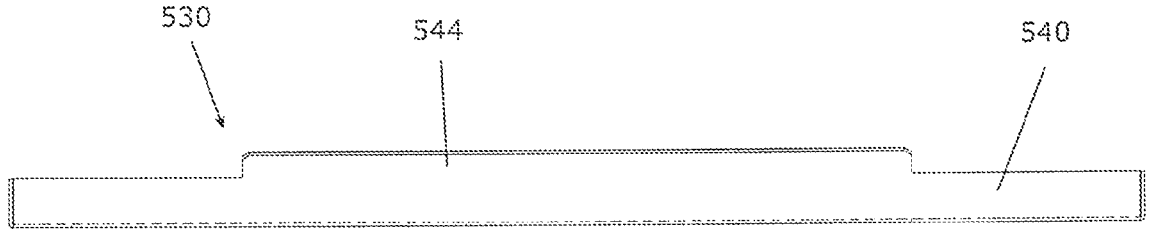
FIG. 89 is a right side view of the tray of FIG. 87.
Figure 90:
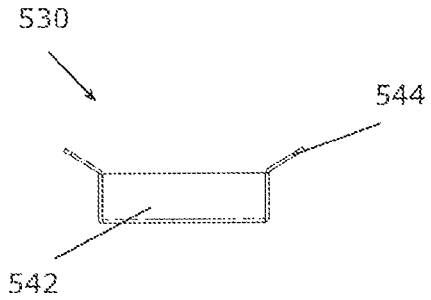
FIG. 90 is a front view of the tray of FIG. 87.

As shown in FIG. 86, and according to an exemplary embodiment, the light rail 512 of the luminaire is similar to the light rails of the luminaires shown in the prior figures except that the light rail 512 has am open slot 536 for receiving the tray 530. FIGS. 87-90 show an exemplary embodiment of the tray 530. The tray 530 includes a bottom 538, first and second side walls 540, and first and second end walls 542. First and second flanges 544 extend from the first and second side walls 540, respectively. The bottom 538 includes a circular opening 546 and a primary rectangular opening 548. The tray 530 can be inserted into the light rail 512 with either the circular opening 546 or rectangular opening facing outwardly 548, toward the end of the light rail 312, depending on the type of sensor module used. The light rail 512 and the tray 530 can be used with different luminaire components depending on the type of sensor module. The tray 530 may be modified to include any size, shape, or configuration of opening to accommodate different sensors.

Figure 91:
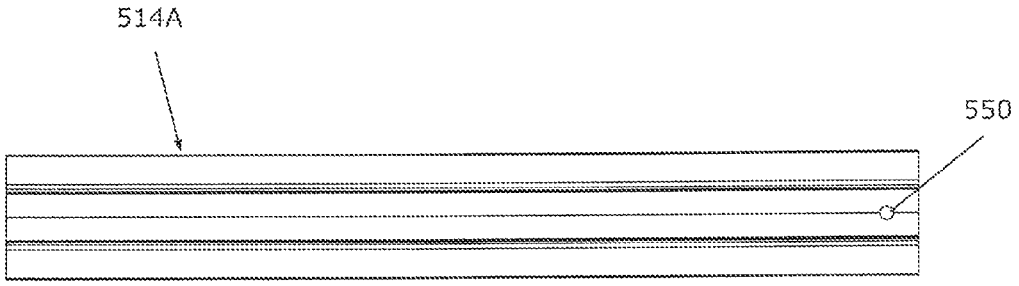
FIG. 91 is a top view of the lens of FIG. 83.
Figure 92:
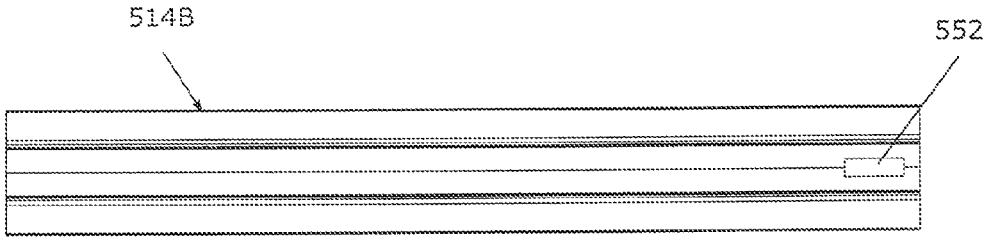
FIG. 92 is a top view of another exemplary lens.

FIG. 91 depicts an exemplary lens 514A for use with the round sensor 510A. The lens includes a round aperture 550 to allow the sensor to pass through the lens. FIG. 92 depicts and exemplary lens 514B for use with the rectangular sensor 510B. The lens 514B includes a rectangular aperture 552 to allow the sensor 310B to pass through the lens 514B.

Figure 93:
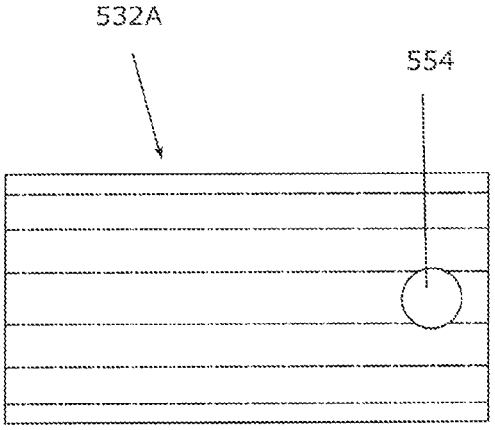
FIG. 93 is a top view of the shield of FIG. 83.
Figure 94:
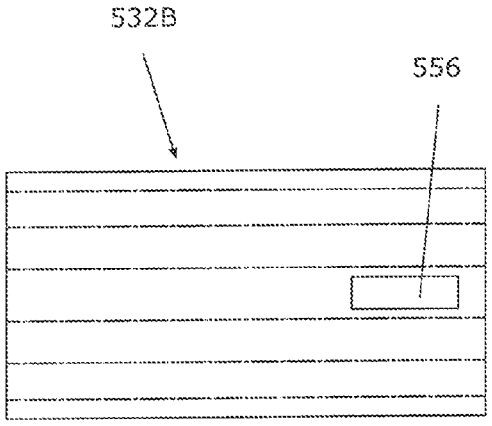
FIG. 94 is a top view of another exemplary shield.

FIG. 93 depicts an exemplary shield 532A for use with the round occupancy sensor 510A. The shield 532A includes a round aperture 554 to allow the sensor to pass through the shield 532A. FIG. 94 depicts an exemplary shield 532B for use with the rectangular sensor 510B. The shield 532B includes a rectangular aperture 556 to allow the sensor to pass through the shield 532B. The appropriate shield 532 can be positioned inside of the lens 514 to hide the tray 530 and sensor components from view through the lens 514. In an exemplary embodiment, the shield 532 is made from an opaque material. The shield 532 can be made from a thin solid piece of material that can be flexed or bent to fit within the lens 514. For example, the shield 532 may flex along the broken lines shown in FIGS. 93 and 94. The shields 532 can be made from a polymer, for example PVC, metal, elastomer, or other suitable flexible material.

Figure 95:
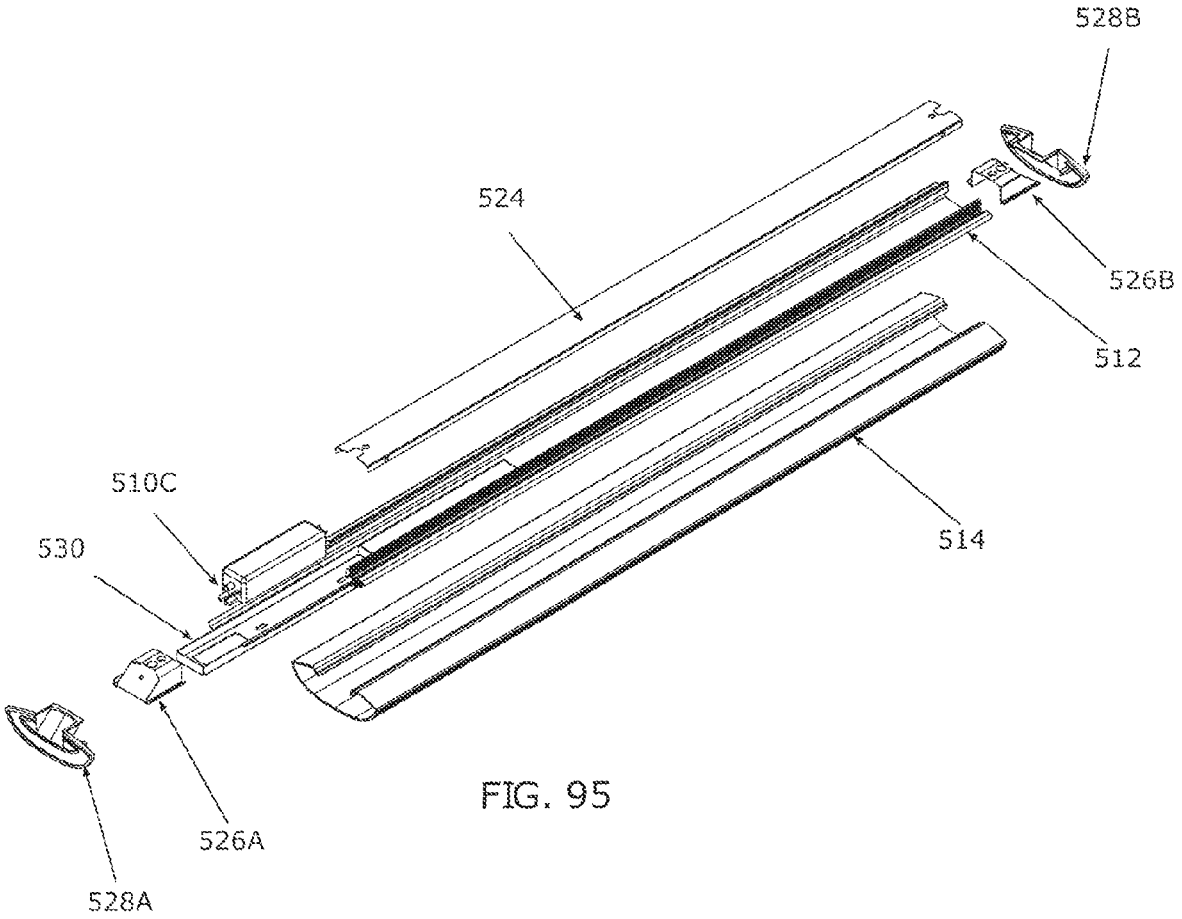
FIG. 95 is an exploded, perspective view of another exemplary luminaire with a control module.
Figure 96:
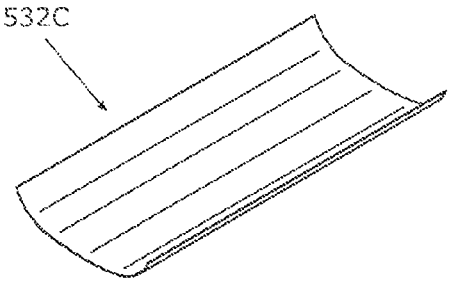
FIG. 96 is a perspective view of another exemplary shield.
Figure 97:
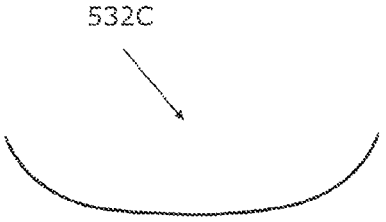
FIG. 97 is a front view of the shield of FIG. 96.

FIG. 95 depicts the luminaire used with a control system 510C, for example a wireless automation and control system, that is placed in the tray 530 and connected to the light rail 512 as discussed above. An exemplary commercial embodiment of such a system is the wiHUBB™ system by Hubbell Incorporated. The control system 510C does not utilize a sensor, and therefore is used in connection with a shield 510C that does not have an opening and covers the entire tray 530. The control system 510C is connected to one or more drivers 518 to control the light output of the luminaire 500.

Figure 98:
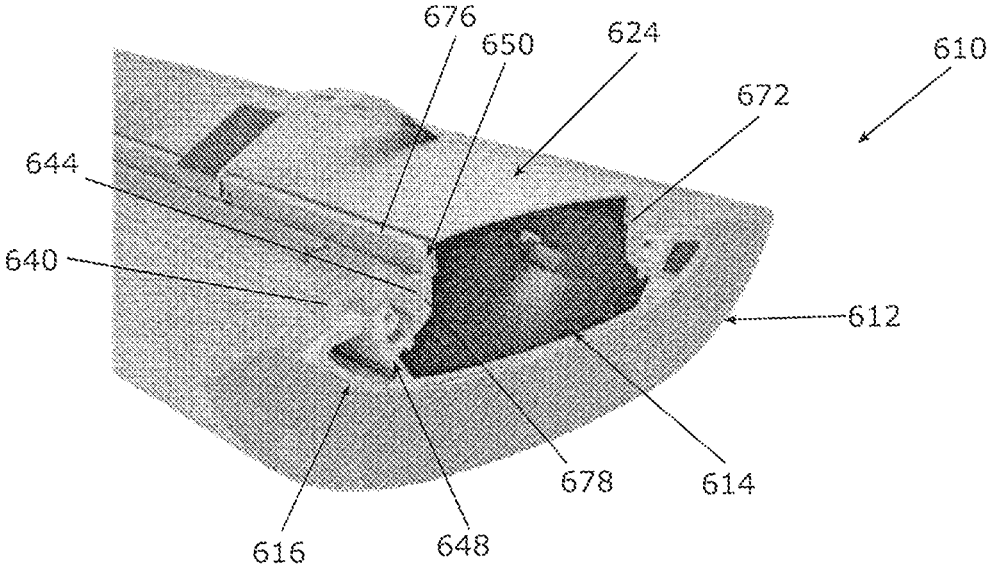
FIG. 98 is a perspective view of a partially assembled luminaire according to another exemplary embodiment.
Figure 99:
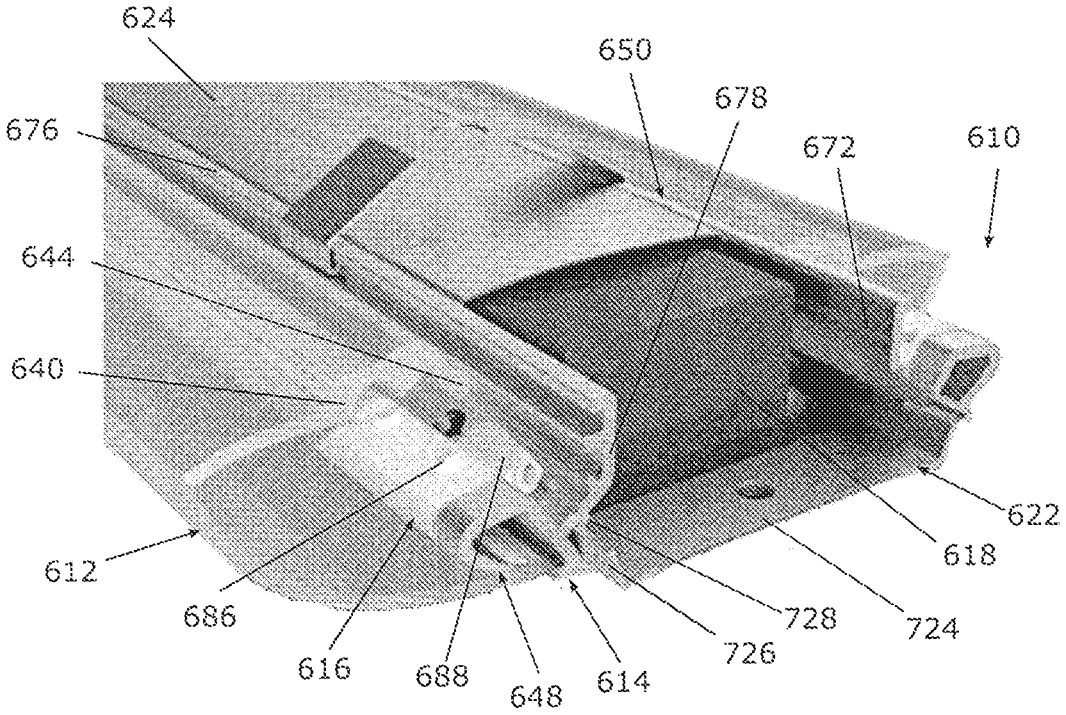
FIG. 99 is a perspective view of the partially assembled luminaire of FIG. 98 with the light rail partially removed from the lens.
Figure 100:
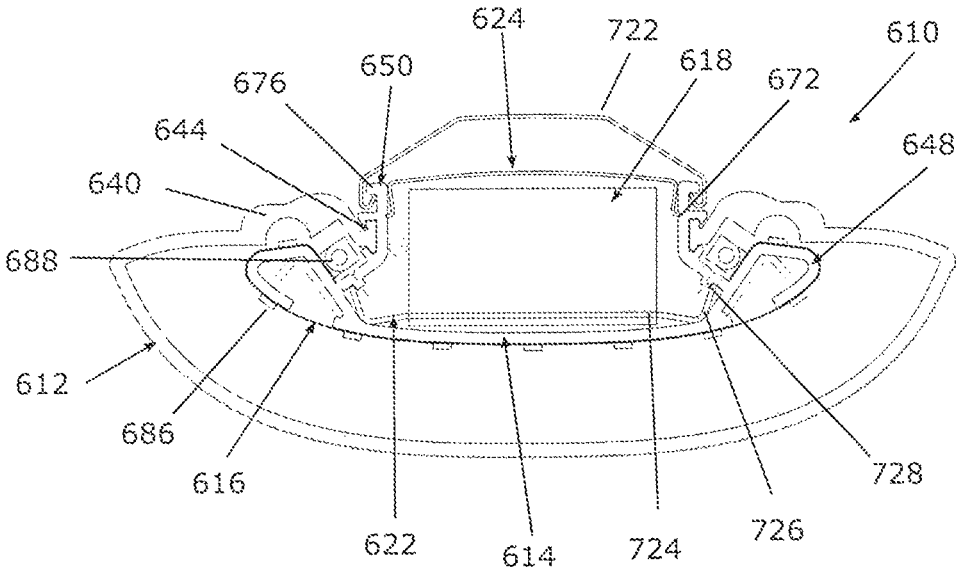
FIG. 100 is a front view of the partially assembled luminaire of FIG. 98.

FIGS. 98-100 illustrate another exemplary luminaire 610. The LED light sheet 616 is mounted to the light rail 614 with the LED sheet 616 wrapping around the bottom section 630 and first and second hooks 648 of the light rail 614. The LED light sheet 616 is arranged on the light rail 614 so that at least one row of LEDs 686 is positioned in or substantially underneath the cylindrical groove 640 of the lens 612. According to an exemplary embodiment, the LED light sheet 616 is connected to the light rail 614 through an adhesive, for example a double-sided tape, although other adhesives or a mechanical connection, such as clips or fasteners, may also be used.

The lens 612 is connected to the light rail 612 by connecting the first and second flanges 644 of the first and second arms 650 of the lens 612 with the first side channel 678 of the light rail 614, respectively. The first and second flanges 650 can be slidably connected into the first side channels 678 or they may be snap or pressed fit into the channels, with the flanges 644 pressing past and flexing the angled surface of the angled prong.

A top cover 624 is connected to the light rail 614 by engaging a flange of the top cover 624 with the second notches 672 formed in the second portions 662 of the light rail 614 first and second arms 650. The top cover 24-2 may be slidable connected or snap fit to the light rail 614. A suspension bracket 722 having a top, angled sides, and a hook is connected to the light rail 614, for example through engagement of the suspension bracket hook and the light rail third protrusion 676 and/or second side channel 680. The suspension bracket 722 may be slidable connected, snap fit, or press fit to the light rail 614. For example the suspension bracket 722 may be resilient and expand as it is pressed over the light rail 614, with the hooks springing back towards their initial position after clearing the third protrusion 672. The top of the suspension bracket 722 includes an aperture for connecting to a suspension cable (not shown). The driver 618 is positioned in the light rail center channel 682 and connected to the light rail 614 through one or more driver brackets 622. The driver bracket 622 shown in FIGS. 97-100 has a bottom section 724 and first and second sidewalls 726 extending at an angle upwardly from the bottom section 724. The first and second sidewalls 726 engage an inwardly extending protrusion 728 on the first portions 660 of the light rail first and second arms 650. An aperture receives a fastener (not shown) to connect the driver bracket with a flange on the driver 618. The driver bracket 122-2 may be slidable connected or snap fit to the light rail 614. One or more electrical conductors extend from the driver 618 through the light rail 614 to connect to the LED sheet 616.

Figure 101:
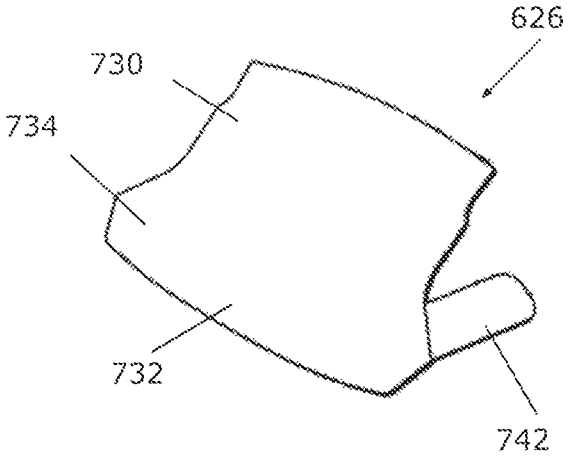

FIG. 101 shows a second exemplary embodiment of a side cover 626 having a top section 730 and a bottom section 732. In various exemplary embodiments, the second side cover 626 is configured to mate with the light rail 614 shown in FIGS. 91-100. The bottom section 732 has a shoulder 734 that is wider than the top section 730, but lacks the substantially horizontal edge 736 of the first side cover. One or more projections 742 extend from the bottom section 732 to position the second side cover 726 on the light rail 714. The projections 742 abut the inwardly extending protrusion 728 on the first portions of the light rail 614 first and second arms 650. In various exemplary embodiments, the side cover 626, is made from metal, for example stainless steel or aluminum. Other materials and configurations of side covers may be used depending on the configuration of the light rail 614 and the driver 618.

Figure 102:
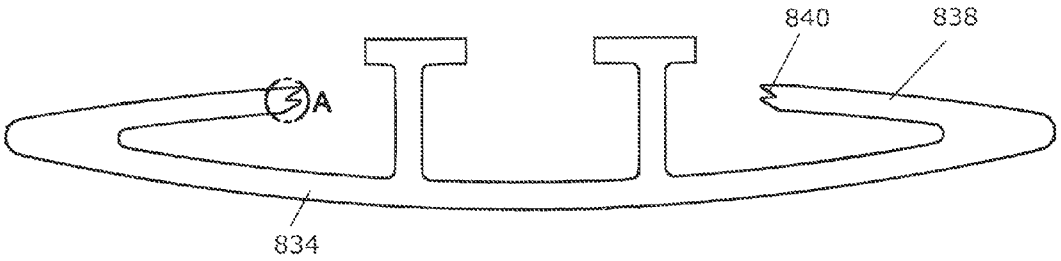
Figure 102A:
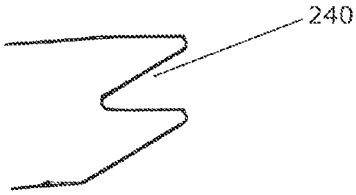
Figure 103:
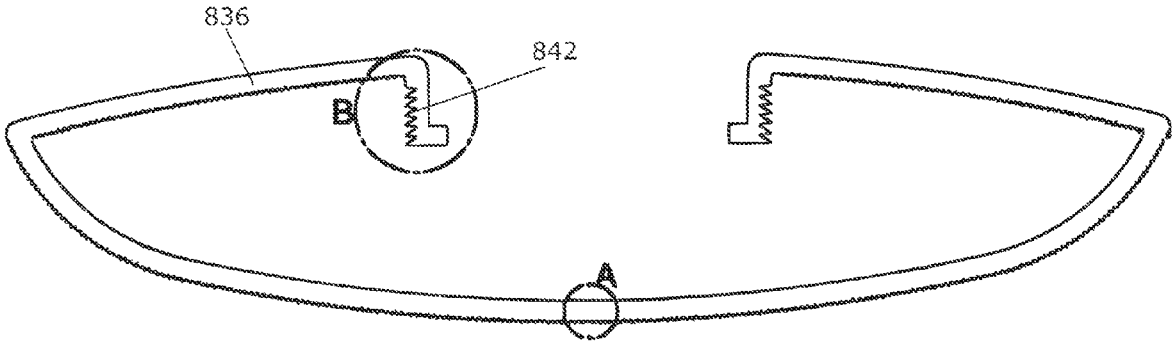
Figure 103A:
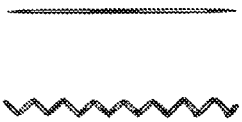
Figure 103B:
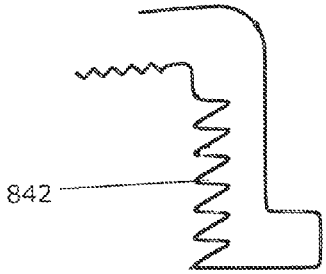

FIGS. 102-103A show another alternative embodiment of a light rail 834 and lens 836 assembly. The light rail 834 has first and second arms 838 having a free end with a substantially V-shaped notch 840. The lens 836 has a series of substantially V-shaped protrusions 842 configured to mate with the V-shaped notch 840 of the light rail 834. The light rail 836 is adjustably positioned on the light rail 834 by engaging the notch 840 with different sets of protrusions 842.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A luminaire comprising:

a support;

a lens connected to and engaging the support;

a sheet connected to the support and positioned between the lens and the support, the sheet having a plurality of LEDs, wherein a first LED is positioned in a first direction and a second LED is positioned in a second direction different from said first direction;

a top cover connected to and engaging the support;

a driver positioned in the support and electrically connected to the plurality of LEDs;

an end bracket connected to and engaging the support; and an end cap connected to and engaging the support covering the end bracket.

2. The luminaire of claim 1, wherein the support includes a bottom, first and second side hooks extending from the bottom, and first and second arms extending from the first and second side hooks, respectively.

3. The luminaire of claim 1, wherein the lens includes an outer surface having a first set of prisms and an inner surface having a second set of prisms.

4. The luminaire of claim 3, wherein said first set of prisms include one or more rounded convex surfaces and said second set of prisms includes one or more rounded concave surfaces and one or more flat surfaces.

5. The luminaire of claim 1, wherein the end bracket includes a top section, a front wall, first and second side walls, a first aperture, and a second aperture.

6. The luminaire of claim 1, further comprising a second top cover connected to the support and a center bracket connecting the top cover and the second top cover.

7. A luminaire comprising:

a first support having an open first end;

a first lens connected to the first support;

a second support having an open second end;

a second lens connected to the second support;

a joiner rail connected to the open first end of the first support and the open second end of the second support; and a joiner bracket connected to the joiner rail.

8. The luminaire of claim 7, further comprising an optical spacer connected to the joiner rail between the first and second lens, wherein the optical spacer is translucent.

9. The luminaire of claim 7, further comprising a first cover connected to the first support and the joiner bracket and a second cover connected to the second support and the joiner bracket.

10. The luminaire of claim 8, wherein the optical spacer includes a central region, an outer rim, and an outer flange.

11. The luminaire of claim 10, wherein the outer flange includes one or more prisms.

12. A luminaire comprising:

a support;

a lens connected to the support;

a light element positioned between the support and the lens;

a tray connected to the support and having a recessed portion; and a control component received in the recessed portion of the tray.

13. The luminaire of claim 12, wherein the support includes a slot slidably receiving the tray.

14. The luminaire of claim 12, wherein the tray includes an opening configured for a sensor module.

15. The luminaire of claim 12, wherein the tray includes a first opening configured for a first sensor module and a second opening configured for a second sensor module.

16. The luminaire of claim 15, wherein the first opening is curvilinear and the second opening is rectilinear.

17. The luminaire of claim 12, wherein the control component is one of a occupancy sensor and a wireless control component.

18. The luminaire of claim 12, further comprising a shield positioned between the lens and the tray.

19. The luminaire of claim 18, wherein the shield includes an opening configured for a sensor.

20. The luminaire of claim 19, wherein the opening is curvilinear or rectilinear.

* * * * *